US011472511B2

(12) United States Patent
Mckee

(10) Patent No.: US 11,472,511 B2
(45) Date of Patent: Oct. 18, 2022

(54) HYDROFOIL WING ATTACHMENT SYSTEM

(71) Applicant: Menko David Mckee, Haleiwa, HI (US)

(72) Inventor: Menko David Mckee, Haleiwa, HI (US)

(73) Assignee: Menko Mckee, Haleiwa, HI (US)

( * ) Notice: Subject to any disclaimer, the term of this patent is extended or adjusted under 35 U.S.C. 154(b) by 0 days.

(21) Appl. No.: 16/742,913

(22) Filed: Jan. 15, 2020

(65) Prior Publication Data

US 2021/0214045 A1 Jul. 15, 2021

(51) Int. Cl.
*B63B 1/24* (2020.01)
*B63B 32/60* (2020.01)
*B63B 34/45* (2020.01)

(52) U.S. Cl.
CPC ..... *B63B 1/242* (2013.01); *B63B 32/60* (2020.02); *B63B 34/45* (2020.02)

(58) Field of Classification Search
CPC ..... B63B 1/24; B63B 1/242; B63B 1/246; B63B 1/248; B63B 1/26; B63B 32/00; B63B 32/10; B63B 32/60; B63B 34/40; B63B 34/45
See application file for complete search history.

(56) References Cited

U.S. PATENT DOCUMENTS 6,551,158 B2 * 4/2003 Murphy ..... B63B 32/20 441/72
7,232,355 B2 * 6/2007 Woolley ..... B63B 34/45 441/65

FOREIGN PATENT DOCUMENTS

FR 2744981 A1 * 8/1997 ..... B63B 32/60
FR 3049262 A1 * 9/2017 ..... B63B 32/60
WO WO-2016071625 A2 * 5/2016 ..... B63B 32/60

* cited by examiner

*Primary Examiner* — Ajay Vasudeva

(57) ABSTRACT

A hydrofoil wing attachment system that comprises a strut or struts and a hydrofoil wing fastening apparatus for various watercraft including, but not limited to, surf boards, kite boards, and stand up paddle boards. In one embodiment the system interfaces with legacy surfboard fin-box systems, thus allowing a user to interchange fins for hydrofoils and transform their watercraft into a hydrofoil watercraft. Other embodiment's of the system allow the implementation of a single-strut/wing combination and also a double-strut/wing combination among other variations. The design of the wing clamping apparatus allows the user to mechanically secure the wing and also configure the angle of attack of the hydrofoil wing. The modular design, configuration options, and high degree of interchangeability of the hydrofoil wing attachment system enables the user to experiment with multiple strut/wing configurations, wing/strut designs, and also the angle of attack.

9 Claims, 23 Drawing Sheets

Prior Art

HYDROFOIL WING ATTACHMENT SYSTEM

TECHNICAL FIELD

The present invention relates to the field of watercraft/surf-craft and applies the concepts of a hydrofoil to water-borne craft, and more specifically to hydrofoil strut and wing attachment systems. A hydrofoil is a wing-centric device designed to provide "lift" to a watercraft such as a surfboard, sailboat, boat, and other water-craft. Generally, a hydrofoil comprises a horizontally oriented wing-like structure connected to a watercraft via one or more vertically oriented struts or masts. As a watercraft increases in speed, the flow of water across a hydrofoil wing generates lift which, in turn, raises the watercraft and results in increased speed and decreased friction.

BACKGROUND—PRIOR ART

The following is a tabulation of some prior art that presently appears relevant:

| Pat. No. | Kind Code | Issue Date | Patentee/Applicant |
|---|---|---|---|
| 10,358,193 | B1 | 2019 Jul. 23 | Lobisser |
| 9,789,935 | B1 | 2017 Oct. 17 | Aguera |
| 9,643,694 | B1 | 2017 May 9 | Geislinger |
| 652929B2 | AU | 1994 Sep. 15 | Woolley |

Non-Patent Video Content

Clayisland. "Foil Surfing Wipeouts." YouTube, uploaded by clayisland, 7 Oct. 2018, youtube.com/wratch?v-jjiW5Yh1MnU.

Movie, Horue. "BEST FOILING WIPEOUTS 2019|Foil-board fails & crashes compilation." YouTube, uploaded by Horue Movie, 8 Jan. 2020, youtube.com/watch?v=nRVhK0_imk.

Current state of the art hydrofoil attachment designs for personal watercraft and surf-craft utilize a fuselage oriented hydrofoil design. The fuselage oriented hydrofoil design is exemplified by FIG. 1 of U.S. Pat. No. 9,643,694 to Geislinger (2017) targeting a kiteboarding/jetski application. This design was then adapted for a more surfboard-centric application which is embodied by FIG. 2 of U.S. Pat. No. 9,789,935 to Aguera (2017) and FIG. 2. of U.S. Pat. No. 10,358,193 to Lobisser (2019).

The above cited prior art examples attach permanently or semi-permanently at the board/mast, mast/fuselage, and fuselage/hydrofoil wing interface. I have found that these attachment methods give little flexibility upon implementation and during operation. Furthermore I have found that the installation and implementation of the fuselage hydrofoil design demands the creation of a custom board and a custom mast attachment both of which are expensive and also very difficult to alter or reconfigure once installed.

The prior art examples rely on the hydrofoil fuselage design which I have found to perform sub-optimally across numerous applications. One of the main reasons is the evolutionary history and subsequent adaptations of the fuselage hydrofoil design. One of the first applications was for towing a seated user behind a boat as demonstrated in FIG. 1 of AU Patent 652929B2 to Woolley (1994). It was then adapted for kiteboarding Geislinger (2017). And now the fuselage hydrofoil design is being adapted to a more surf-centric application with Aguera (2017) and Lobisser (2019).

Due to the copycat and borrowed nature of the design's evolutionary path, coupled with the lack of organic and purpose driven design I have found the design wanting in the realm of performance, ease of use, and ability to implement.

Another reason for the sub-optimal performance characterized by the fuselage hydrofoil design is due to the wing attachment method and location of the hydrofoil fuselage in relation to both the leading wing and trailing wing to the main attachment mast. I have found that this distance facilitates a large amount of friction, vibration, and instability which makes the fuselage hydrofoil more susceptible to structure failure due to vibration/shearing forces and also prone to pitching a rider off the watercraft (Clayisland 00:01-00:21 and 00:53-01:19). The operational behavior of the hydrofoil fuselage design is especially dangerous as it dramatically increases the chances of having the fuselage hydrofoil toppling/whipping back with high velocity onto/upon the rider after a fall and causing injury (Movie 00:23-00:26).

I have found that the aforementioned performance shortcomings and structural characteristics, lack of flexibility and high cost during both implementation and operation, and the danger inherent in the hydrofoil fuselage design make it a sub-optimal choice for many hydrofoil based applications.

SUMMARY OF INVENTION

In accordance with an embodiment described in this application is a hydrofoil wing attachment system that enables water sport enthusiasts to attach a hydrofoil wing to various types of watercraft including, but not limited to, surf boards, kite surfing boards, stand up paddle boards. The hydrofoil wing attachment system consists of various interconnected components.

The base connection joins a strut body to a watercraft. The base connection can consist of various embodiments such as but not limited to commonly utilized fin connection systems, joining via one piece fabrication or through permanent means such as setting in place with a fiber reinforced resin system.

A wing clamping apparatus is affixed to the strut body and sandwiches the hydrofoil wing around a longitudinal section of the wing via an interlocking interface. Various securing mechanisms within the wing clamping apparatus secure the hydrofoil wing using mechanical pressure exerted upon both the top and bottom of the hydrofoil wing. The securing mechanisms within the wing clamping apparatus also enable a user to change the tilt of the hydrofoil wing or the angle of attack (AOA).

DRAWINGS—REFERENCE NUMERALS

Figure 1A:
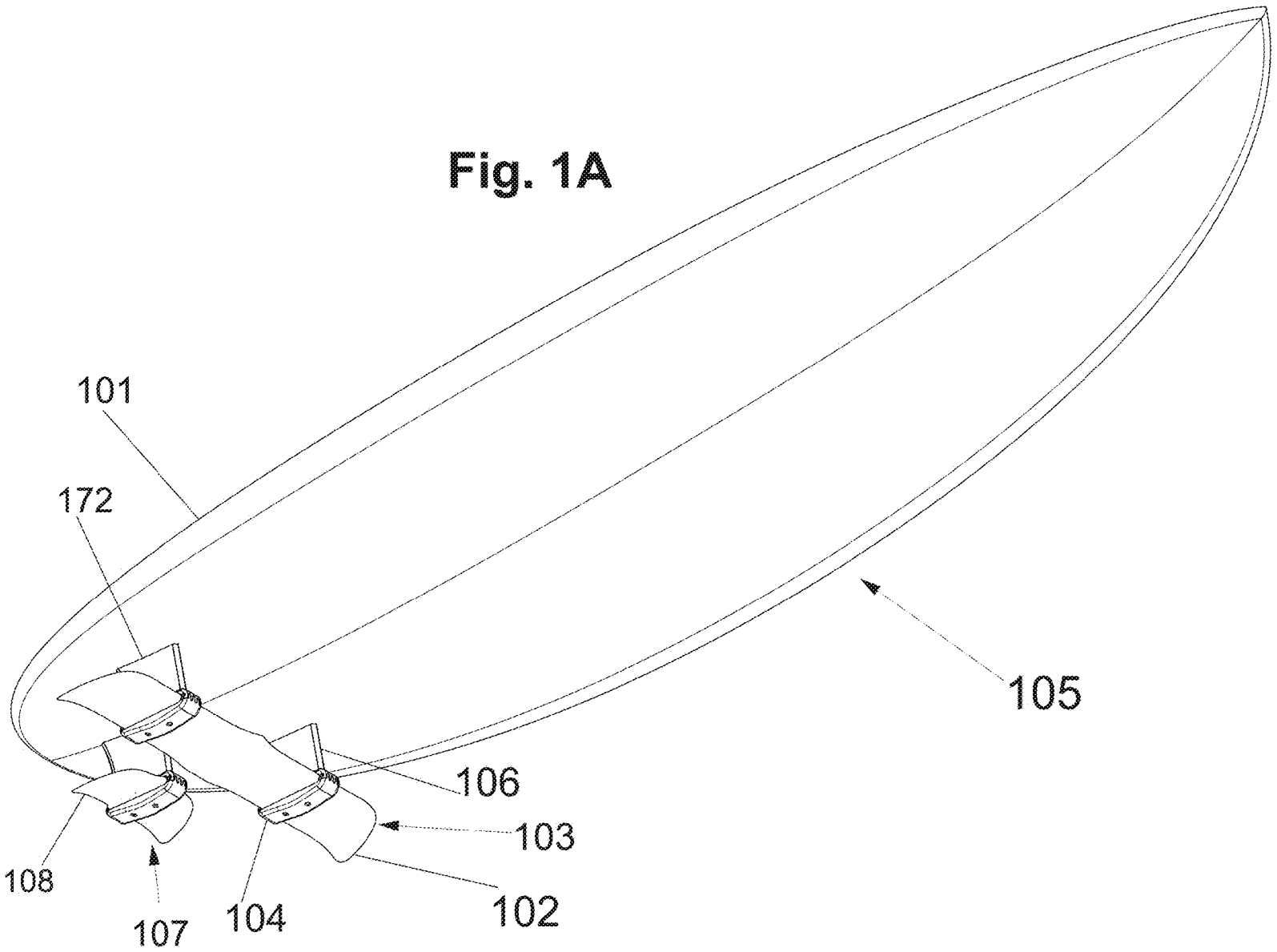
FIG. 1A shows a view of two embodiments of the hydrofoil wing attachment system implemented upon a surfboard with a three fin set up, encompassing a double-strut wing assembly, and a single-strut wing assembly.

| Reference Part # | Description |
|---|---|
| 101 | surfboard with three fin set up |
| 102 | hydrofoil wing for double-strut implementation |
| 103 | double-strut hydrofoil wing assembly |
| 104 | connector clamp head |
| 105 | three fin surfboard with one attached double-strut hydrofoil wing assembly and one attached single-strut hydrofoil wing assembly |
| 106 | hydrofoil wing attachment strut body - rake type of forward |
| 107 | hydrofoil wing attachment single-strut assembly |
| 108 | hydrofoil wing for single-strut implementation |
| 109 | three fin surfboard with three single-strut hydrofoil wing attachment assemblies |
| 110 | Legacy surfboard fin-box insert relating to U.S. Pat. No. 5,830,025 to Fleming (1998) |
| 111 | hydrofoil wing attachment system strut assembly - rake type of forward |
| 112 | anterior recessed nut well |
| 113 | hydrofoil wing attachment leading edge point of separation design |
| 114 | Anterior "toothed" connection interface between connector clamp head and strut clamp head |
| 115 | hydrofoil wing trailing edge indent design |
| 116 | strut clamp head |
| 117 | hydrofoil wing trailing edge swallow hill design |
| 118 | posterior recessed area for bolt head to fit |
| 119 | shaft encased in strut for set screw to tighten wing tilt |
| 120 | hydrofoil wing attachment strut wing tilt tightener entry point (for use with set screw) |
| 121 | nut well encased in hydrofoil wing attachment strut for tightening set screw |
| 122 | anterior connector clamp head set screw entry point |
| 123 | curvature of hydrofoil wing tip |
| 124 | posterior connector clamp head set screw entry point |
| 125 | viable attachment section for hydrofoil wing attachment system to clamp around for double-strut hydrofoil implementation |
| 126 | posterior "toothed" connection interface between lower clamp head and strut clamp head |
| 127 | straight leading edge of straightedge hydrofoil wing attachment double-strut wing |
| 128 | spacer cavity of strut clamp head |
| 129 | strut clamp spacer to tighten wing and affect wing tilt |
| 130 | posterior connector clamp head 45 degree interlocking teeth |
| 131 | trailing edge of straightedge hydrofoil wing attachment double-strut wing |
| 132 | connector clamp posterior bolt hole set to connect the strut clamp head with connector clamp head |
| 133 | hydrofoil wing straightedge design for double-strut implementation |
| 134 | recessed cavity for connector clamp head spacer |
| 135 | connector clamp head spacer for tightening the wing |
| 136 | connector clamp head posterior nut well for wing tightening set screw |
| 137 | leading edge of straightedge hydrofoil wing attachment wing for single-strut implementation |
| 138 | connector clamp head anterior nut well for set screw |
| 139 | viable section for hydrofoil wing attachment system strut to clamp to wing for single-strut implementation - allowing for symmetry |
| 140 | anterior bolt hole set to connect the strut clamp head with connector clamp head |
| 141 | anterior bolt hole sets aligned for bolt combining connector clamp head and strut clamp head |
| 142 | anterior connector clamp head 45 degree interlocking teeth |
| 143 | cross section view of various style wings |
| 144 | anterior strut clamp head 45 degree interlocking teeth |
| 145 | sample cross section of single-strut hydrofoil wing attachment wing |
| 146 | strut clamp head anterior bolt holes for connecting the strut clamp head with the connector clamp head |
| 147 | posterior bolt hole sets aligned for bolt combining connector clamp head and strut clamp head |
| 148 | anterior recessed area for bolt head to fit |
| '149 | space where wing sits |

-continued

| Reference Part # | Description |
|---|---|
| 150 | posterior recessed nut well |
| 151 | straight leading edge of hydrofoil wing attachment single-strut wing |
| 152 | posterior strut clamp head 45 degree interlocking teeth |
| 153 | strut clamp head anterior bolt hole set to connect the strut clamp head with connector clamp head |
| 154 | strut clamp head posterior bolt hole set to connect the strut clamp head with connector clamp head |
| 155 | cross section of wing |
| 156 | hydrofoil wing for single-strut assembly implementation with out-dent design at attachment section |
| 157 | displays the chord size |
| 158 | single-strut hydrofoil wing attachment wing with indentation design at attachment section |
| 159 | wing thickness |
| 160 | connection/interface zone that the hydrofoil wing attachment clamp head attaches around on a single-strut wing |
| 161 | hydrofoil wing attachment strut body with a neutral/straight rake |
| 162 | hydrofoil wing attachment strut assembly - neutral/straight rake |
| 163 | hydrofoil wing attachment strut assembly - aft rake |
| 164 | Legacy surfboard fin-box insert relating to prior art U.S. Pat. No. 5,464,359 to Whitty (1995) |
| 165 | hydrofoil wing attachment strut body - aft rake |
| 167 | 50/50 strut profile cross section |
| 168 | 80/20 strut profile cross section - designed with symmetrical left and right |
| 169 | 100/0 (flat) strut profile cross section - designed with symmetrical left and right |
| 170 | wing clamping apparatus |
| 171 | draft measurement of strut |
| 172 | base connection |

DETAILED DESCRIPTION OF INVENTION

An embodiment of the hydrofoil wing attachment system illustrated in FIG. 1A is used for securing a hydrofoil wing to a surfboard that has a three fin configuration. FIG. 1A illustrates a double-strut wing assembly 103 attached at the two forward fin spots/slots and a single-strut wing assembly 107 implemented at the single fin spot/slot at the tail of the board.

The base of the hydrofoil wing attachment system is characterized by a base connection 172 which joins a strut body 106 to a watercraft. In one embodiment of the hydrofoil wing attachment system the design of the base connection insert 164 is compatible with prior art U.S. Pat. No. 5,464,359 to Whitty (1995). Another embodiment of the base connection insert 110 is compatible with prior art U.S. Pat. No. 5,830,025 to Fleming (1998). Other embodiments of the base connection 172 include joining via one piece fabrication or through permanent means such as setting in place with a fiber reinforced resin system among other methods.

Figure 2A:
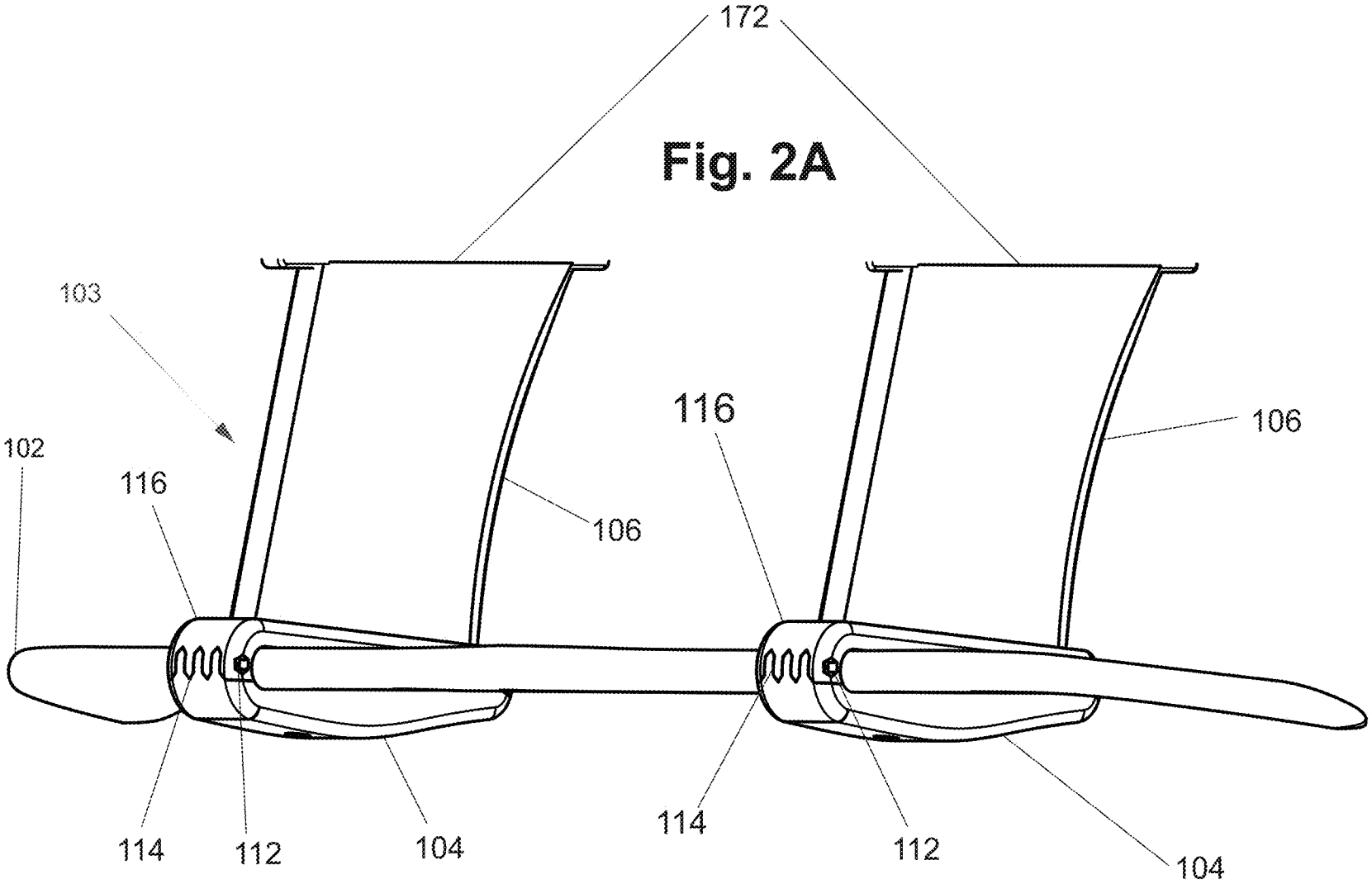
FIG. 2A shows a front-facing isometric view of a double-strut wing assembly.
Figure 2B:
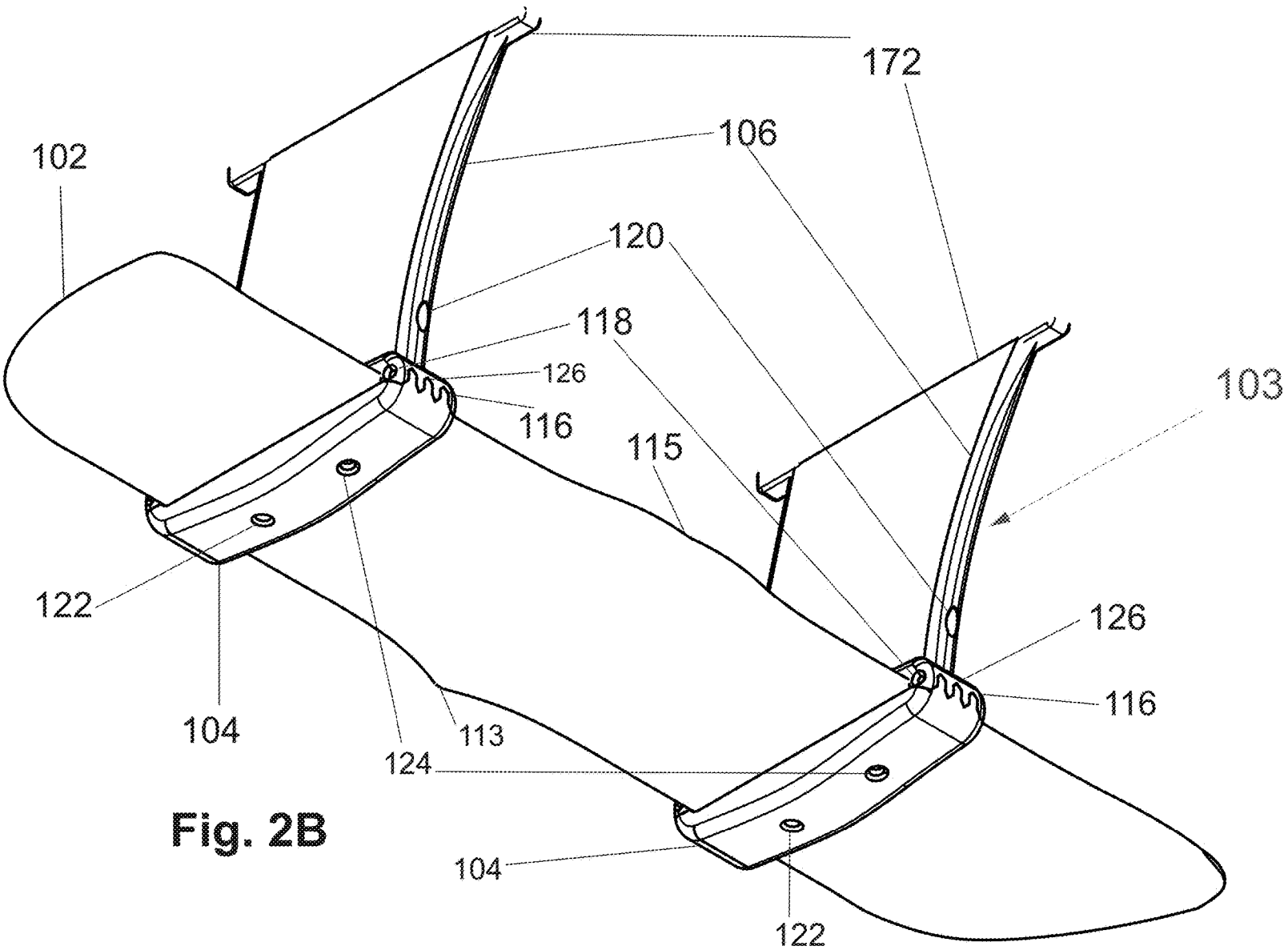
FIG. 2B shows a bottom-facing isometric view of a double-strut wing assembly.

Illustrated in FIGS. 2A and 2B the base connection 172 connects to the strut body 106 which is then joined to a strut clamp head 116. The strut clamp head 116 is connected and interlocks with a connector clamp head 104 and sandwiches and secures the hydrofoil wing designed for the double-strut implementation 102.

Figure 3A:
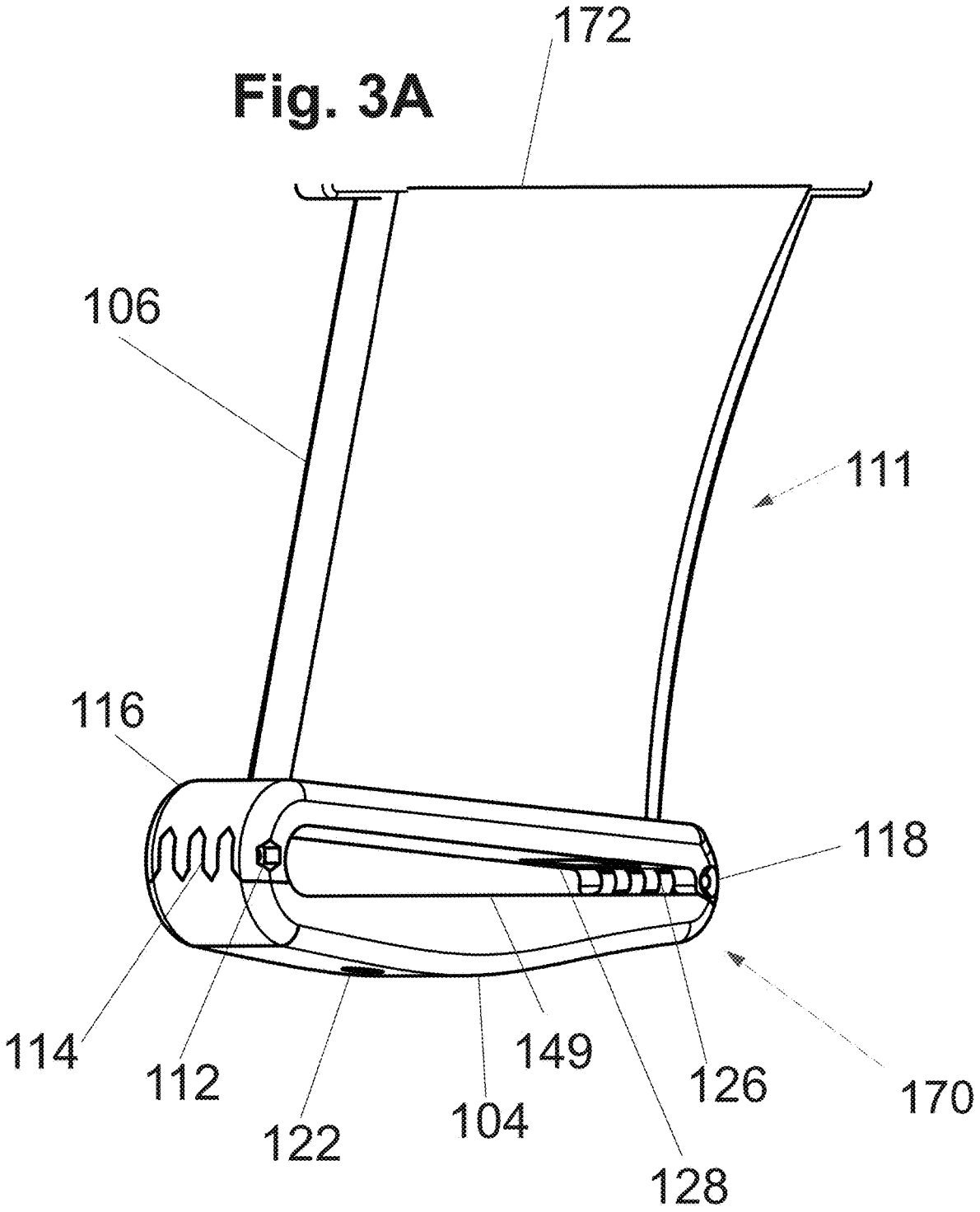
FIG. 3A shows a front-facing isometric view of a strut assembly in the closed clamp head position.
Figure 3B:
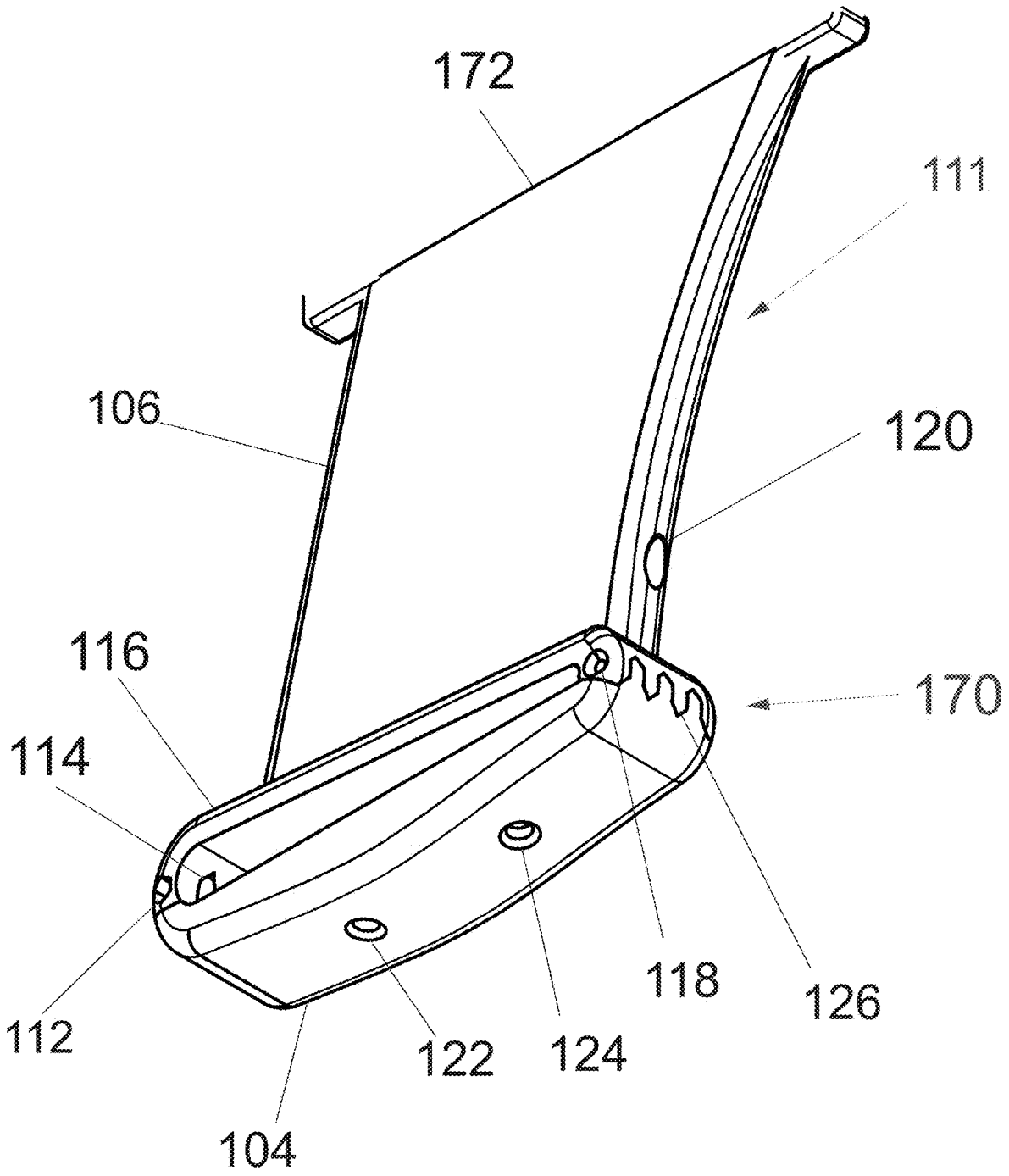
FIG. 3B shows a bottom-facing isometric view of a strut assembly in the closed clamp head position.
Figure 4A:
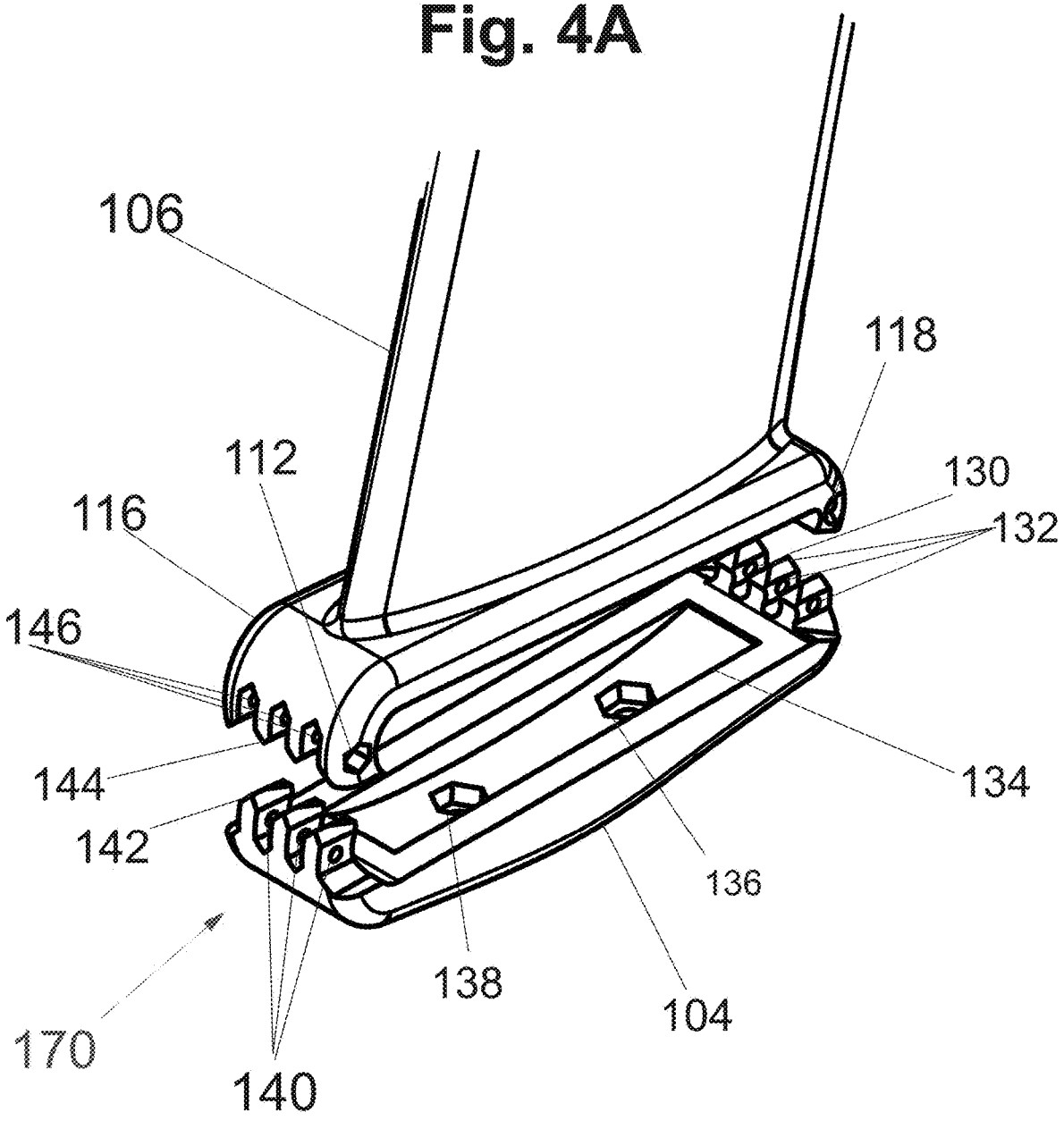
FIG. 4A shows a forward-facing isometric closeup view of a strut assembly in the open clamp head position.
Figure 4B:
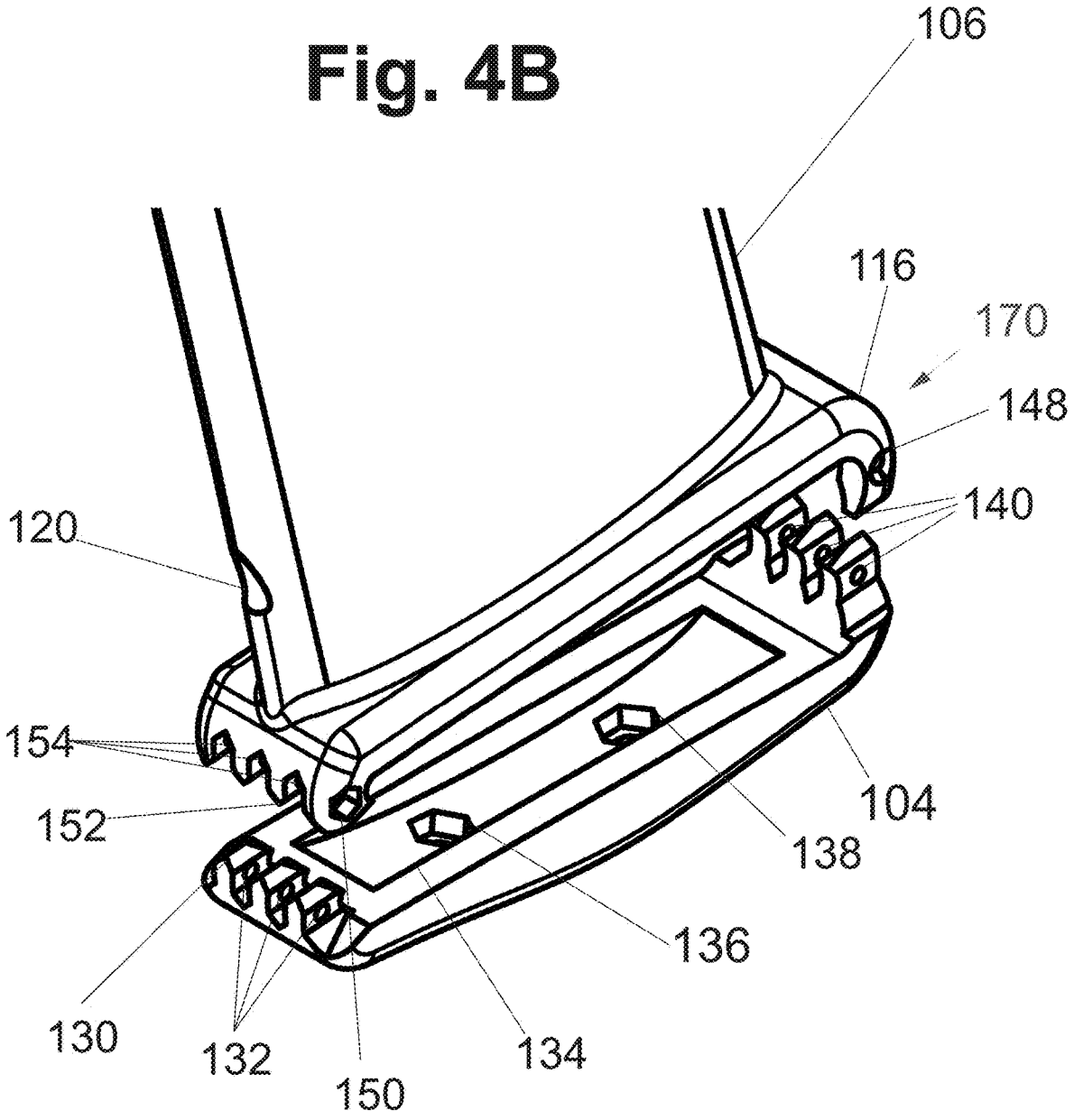
FIG. 4B shows a rear-facing isometric closeup view of a strut assembly in the open clamp head position.

FIGS. 3A and 3B illustrate the above clamp head interconnection in greater detail. The strut clamp head 116 interfaces/connects and interlocks to the connector clamp head 104 at both an anterior interlocking interface 114 and a posterior interlocking interface 126. Connection and interlock are achieved via two main mechanisms:

First, as detailed in FIGS. 4A and 4B the anterior strut clamp head interlocking teeth 144 interface and interlock with the anterior connector clamp interlocking teeth 142 while concurrently the posterior strut clamp head interlocking teeth 152 interface and interlock with the posterior connector clamp interlocking teeth 130. Once the interlocking teeth are locked into place as depicted in FIGS. 3A and 3B. The bolt holes within the teeth of the strut clamp head 146 line up with the connector clamp teeth bolt holes 140 for the anterior interconnection and 154 and 132 for the posterior interconnection respectively.

Second, with the teeth interlocking between the strut clamp head 116 and the connector clamp head 104 and the bolt holes lined up at the anterior and posterior interface. A bolt can be placed through both sets of holes 146 and 140 for the anterior and 154 and 132 for the posterior. With the holes aligned and a bolt placed through the anterior and posterior bolt holes the connection between the strut clamp head 116 and the connector clamp head 104 is fortified. The fortification bolts enter through a recessed circular indent 118 for posterior and 148 for anterior of the strut clamp head 116. The nut to fasten the fortification bolt is then placed within an anterior nut-well 112 and a posterior nut-well 150 for the strut. The fortification bolt can then be tightened against/within the anterior nut-well 112 and the posterior nut-well 150 strongly securing the strut clamp head 116 with the Connector Clamp Head 104. In FIG. 1A the fortified clamp head sandwiches a hydrofoil wing designed for single-strut implementation 108 along a longitudinal section of the hydrofoil wing.

Figure 5A:
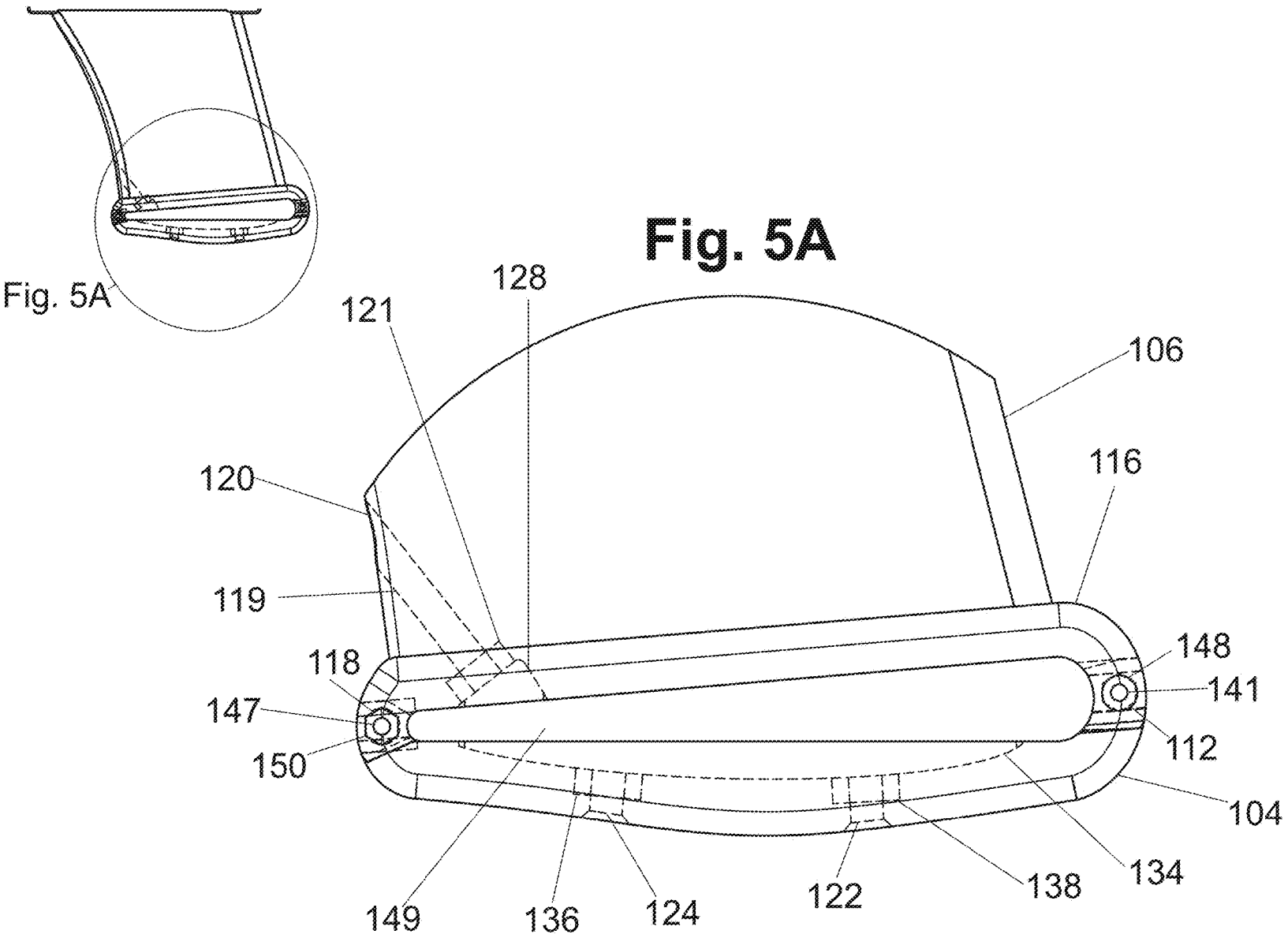
FIG. 5A shows a wire-frame closeup profile view of a strut assembly in the closed clamp head position.

With the hydrofoil wing 108 sandwiched between the strut clamp head 116 and the connector clamp head 104. FIG. 5A illustrates the mechanism for further securing the hydrofoil wing via a pressure exertion mechanism within the strut clamp head 116. The application of mechanical pressure is achieved by using a set screw that travels through a strut side tightening hole 120 down the shaft 119 and is threaded through a nut placed in a strut side tightening nut-well 121. The set screw upon tightening against/within the strut side tightening nut-well 121 presses against a triangle spacer 129 shown in FIG. 5B. The triangle spacer 129 then presses against the top posterior section of the hydrofoil wing to further secure it.

Figure 5B:
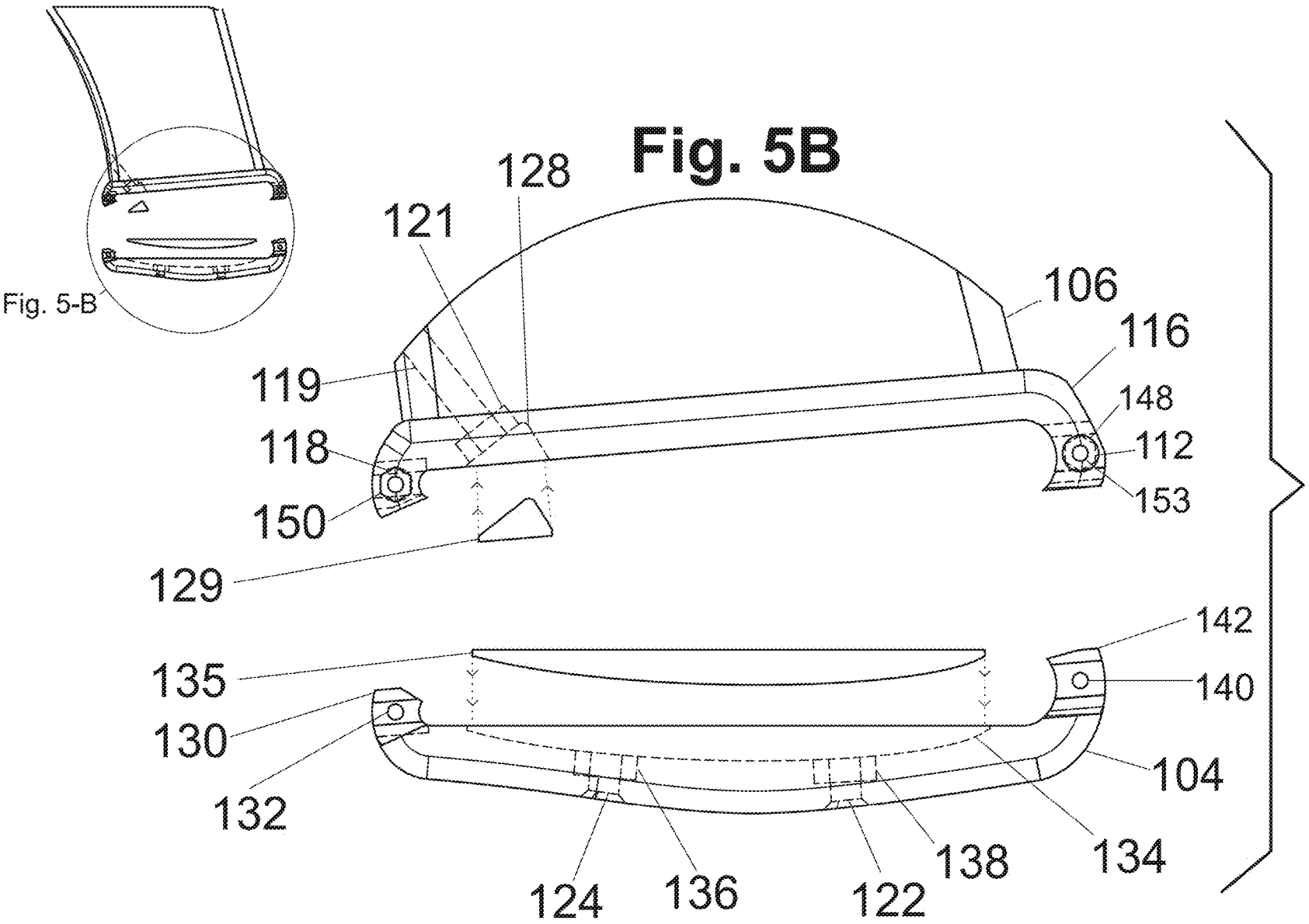
FIG. 5B shows a wire-frame closeup profile view of a strut assembly in the open clamp head position with spacers.
Figure 5C:
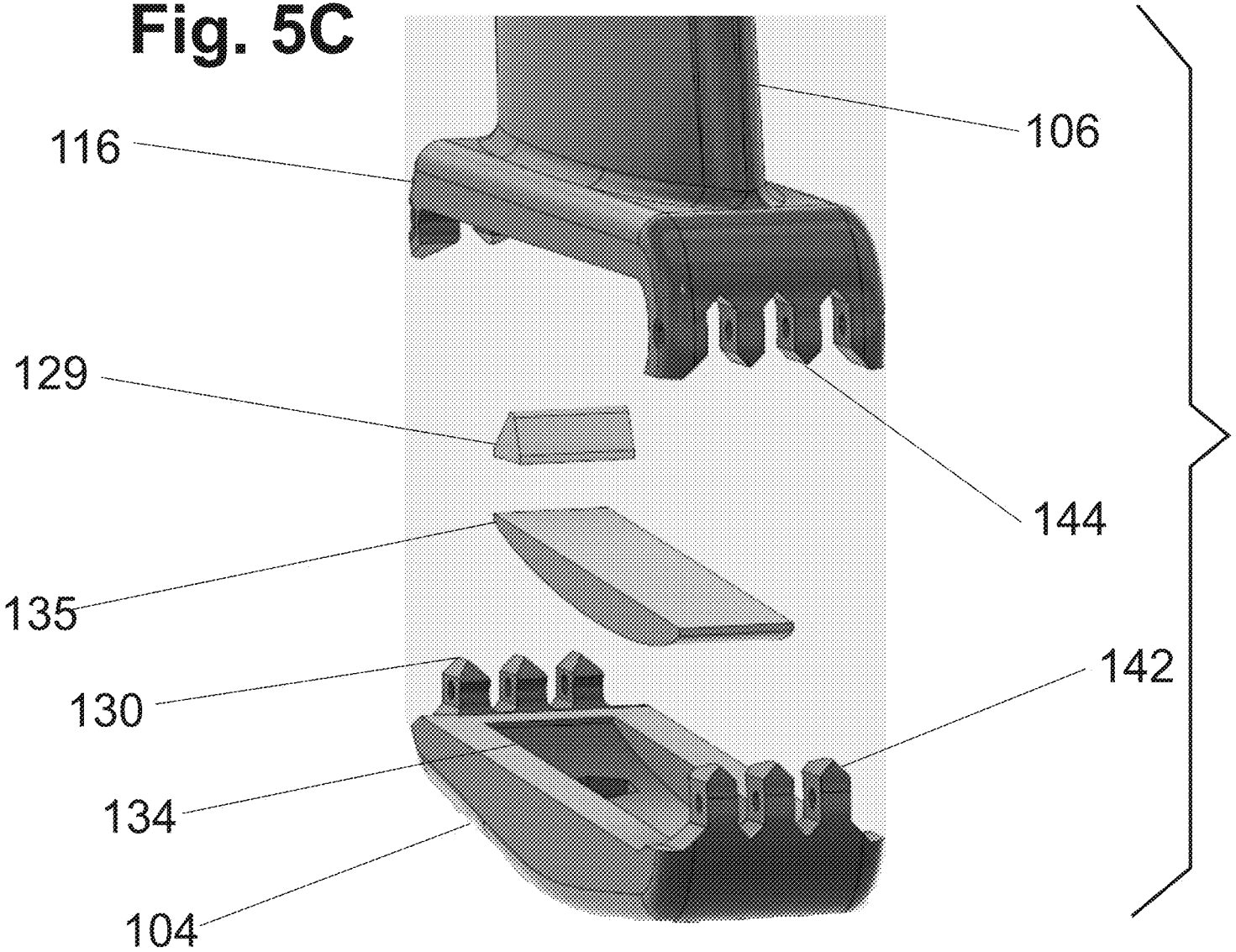
FIG. 5C shows a forward facing isometric closeup view of a strut assembly in the open clamp position.

The connector clamp head 116 also has a mechanical pressure mechanism within the clamp head. As illustrated in FIG. 5B the connector clamp head has two shafts 124 and 122. These two shafts allow set screws to enter and thread through nut-wells 136 and 138. The set screws can be tightened against/within connector clamp tightening nut-wells 136 and 138. As the set screws are tightened they exert mechanical pressure upon a connector clamp head spacer 135. The pressure exerted on the clamp head spacer 135 by the set screws then increases the pressure exerted upon the wing.

The hydrofoil wing is well secured via mechanical pressure sandwiching the wing between the triangle spacer 129 and the connector clamp head spacer 135. The benefits of a well secured hydrofoil wing are myriad and fundamental to the proper operation of a hydrofoil system. Benefits, not exhaustively listed here, include a reduction of drag, friction, vibration, high speed failure events and an increase in stability, maneuverability, reliability and safety.

Another valuable design benefit of a wing clamping apparatus 170 is the ability to adjust the tilt of the wing or angle of attack (AOA). Due to the placement of the tightening spacers 129 and 135 in relation to the top and bottom of the wing. The AOA of the hydrofoil wing can be adjusted to between 0 and 15 degrees depending upon the sequence of tightening actions undertaken between the three tightening set screws present in the wing clamping apparatus 170.

Operation

Due to the systemic and mechanical nature of the hydrofoil attachment wing system some aspects of operation were touched upon and described in the detailed description section. Thus certain steps relating to the operation of the hydrofoil attachment wing system may be repeated in the below section.

To initiate operation of the hydrofoil wing attachment system the base connection 172 must be secured to the watercraft. Once the base connection is securely attached to the watercraft then the wing clamping apparatus 170 can be separated along the interlocking interface so that the connector clamp head 104 is separated from the strut side clamp head 116. The user must make sure that the connection bolts inserted into anterior 148 and posterior 118 bolt holes have been cleared and that there is not a bolt joining the two clamp heads together before attempting separation.

Once the clamp heads have been separated as depicted in FIGS. 4A and 4B. The method of operation would slightly diverge in the case of whether it is a double-strut wing assembly 103 or single-strut wing assembly 107. In the case of the double-strut wing assembly the hydrofoil wing 102 shall be centered across two struts as depicted in FIG. 2B. In the case of the single-strut wing assembly 107 the hydrofoil wing 108 shall be centered upon one strut as depicted in FIG. 2D.

Operation of the Single-Strut Wing Assembly

In preparation for the hydrofoil wing being placed between the strut clamp head 116 and the connector clamp head 104 and then sandwiched between the two clamp heads. The placement of the wing within the strut assembly shall occur prior to interlocking the strut clamp head 116 and the connector clamp head 104. With the two clamp heads separated and the strut secured to the surf-craft, the bottom of the surf craft should be facing up so that the teeth 152 on the strut clamp head 116 are facing up.

At this point the user shall make sure that the triangle spacer 129 is pressed into the fitted hollow 128 within the strut clamp head 116. The wing is then placed within the space between the two clamp-heads 149 with the top of the wing facing the strut clamp head 116. With the wing properly placed into the wing shaped hollow 149. The connector clamp head 104 making sure that the connector clamp head spacer 135 is within the connector clamp head is snapped into place interlocking with the strut clamp head. This interface and connection is facilitated by the 45 degree studded interlocking teeth 144 and 142 at the anterior interface. And interlocking and connection facilitated at the posterior interface with the 45 degree studded interlocking teeth 152 and 130. Make sure that the teeth are properly lined up and even for a proper fit.

Figure 2C:
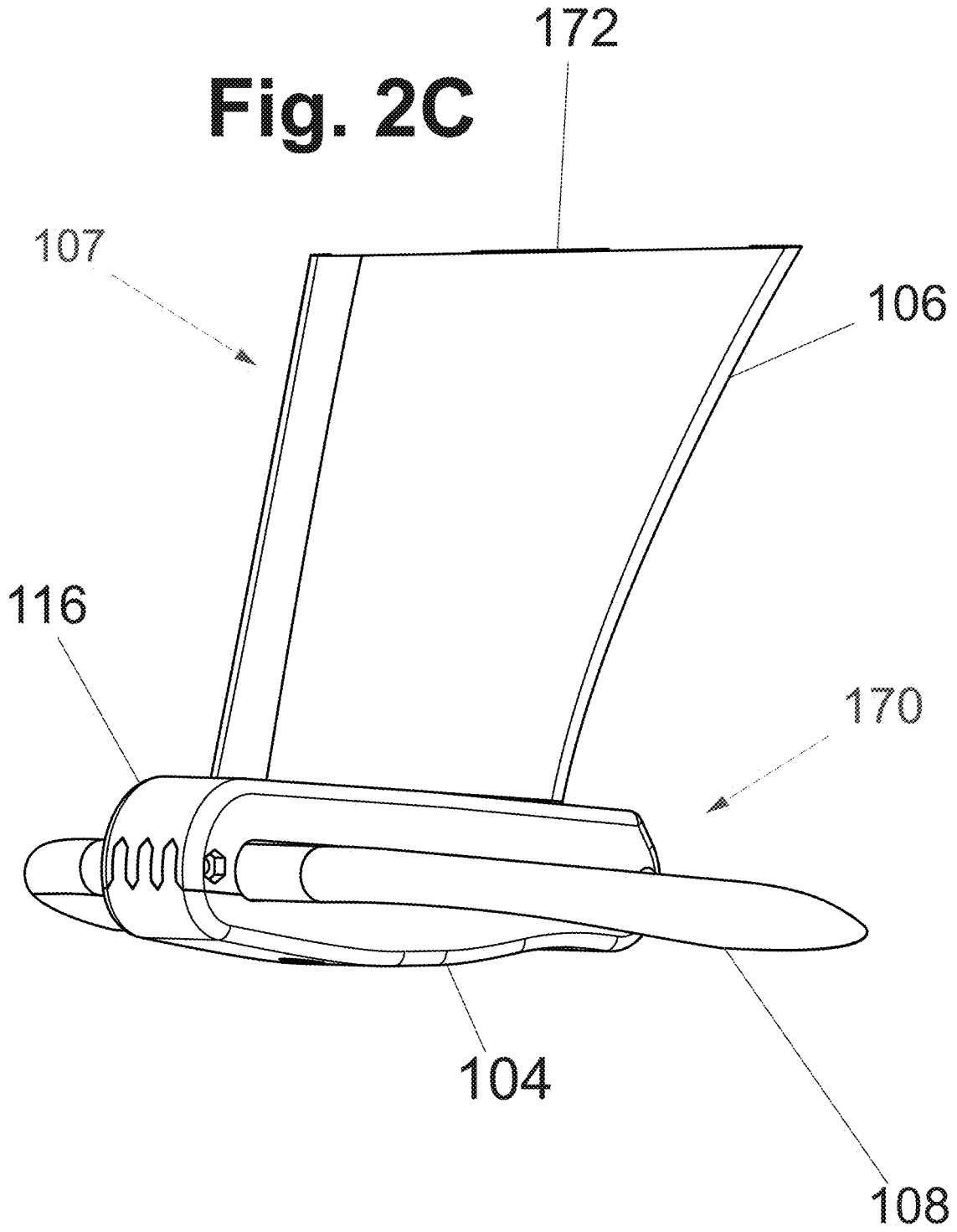
FIG. 2C shows a front-facing isometric view of a single-strut wing assembly.
Figure 2D:
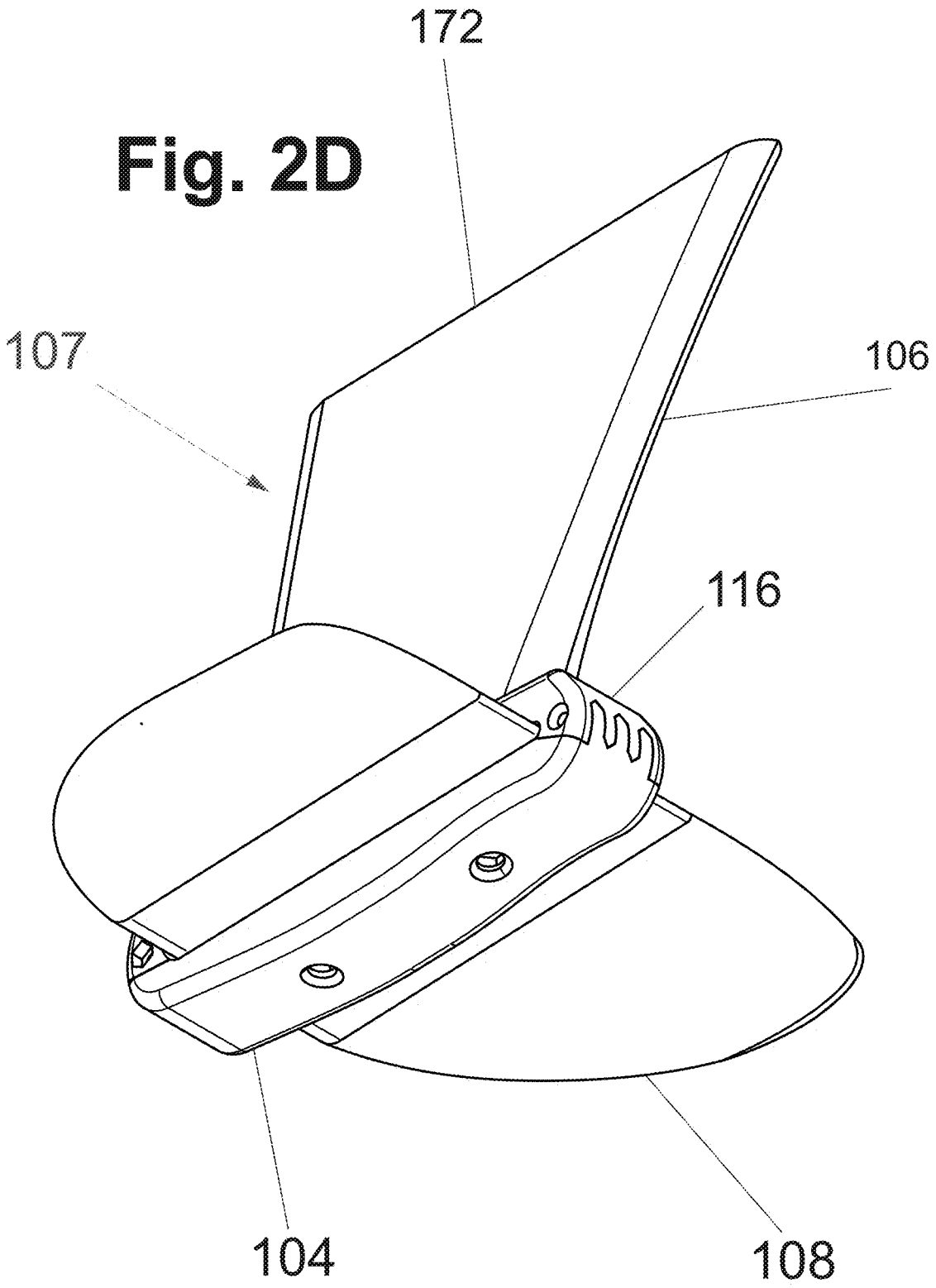
FIG. 2D shows a bottom-facing isometric view of a single-strut wing assembly.

The wing has been snapped into place by the interlocking 45 degree teeth of the wing clamping apparatus 170 in FIG. 2C. At this point the user shall insert a fortification bolt into the recessed posterior bolt hole 118 and one into the anterior recessed bolt hole 148. Concurrently a properly fitted nut shall be placed into both the anterior nut-well 112 and one into the posterior nut-well 150. The fortification bolt shall then be pushed through the bolt hole sets of the posterior 154 and 132 and a second fortification bolt pushed through the anterior bolt hole sets 140 and 146. The anterior and posterior fortification bolts shall then be able to be tightened against the nut within the anterior nut-well 112 and the nut within the posterior nut-well 150.

With the strut clamp head 116 and the connector clamp head 104 fastened together and fortified, the user can now utilize the various pressure exertion mechanisms within the wing clamping apparatus 170. Pressure upon the wing is exerted through three entry points: the anterior connector clamp head set screw entry point 122, the posterior connector clamp head set screw entry point 124 and the strut clamp wing tilt set screw entry point 120.

A set screw shall be placed into each one of these entry points and threaded through the embedded nut within the nut-wells 128, 136, and 138. The user shall first apply pressure by screwing the set screw within the nut-well 128 which will exert mechanical pressure upon the triangle spacer 129 which exerts pressure along the topside of the wing affecting the wing's tilt or angle-of-attack (AOA) of the wing. The operator shall then tighten the set screws at 122 and 124 against the nuts within nut-wells 138 and 136. This tightening action will press the connector clamp spacer 135 against the underside of the wing. Depending upon the angle-of-attack desired for the hydrofoil wing the tightening sequence would vary by instance. The end result of these actions will be a hydrofoil wing 108 that is securely fastened within the wing clamping apparatus 170 that is then securely attached to the watercraft via the strut 106.

Figure 2E:
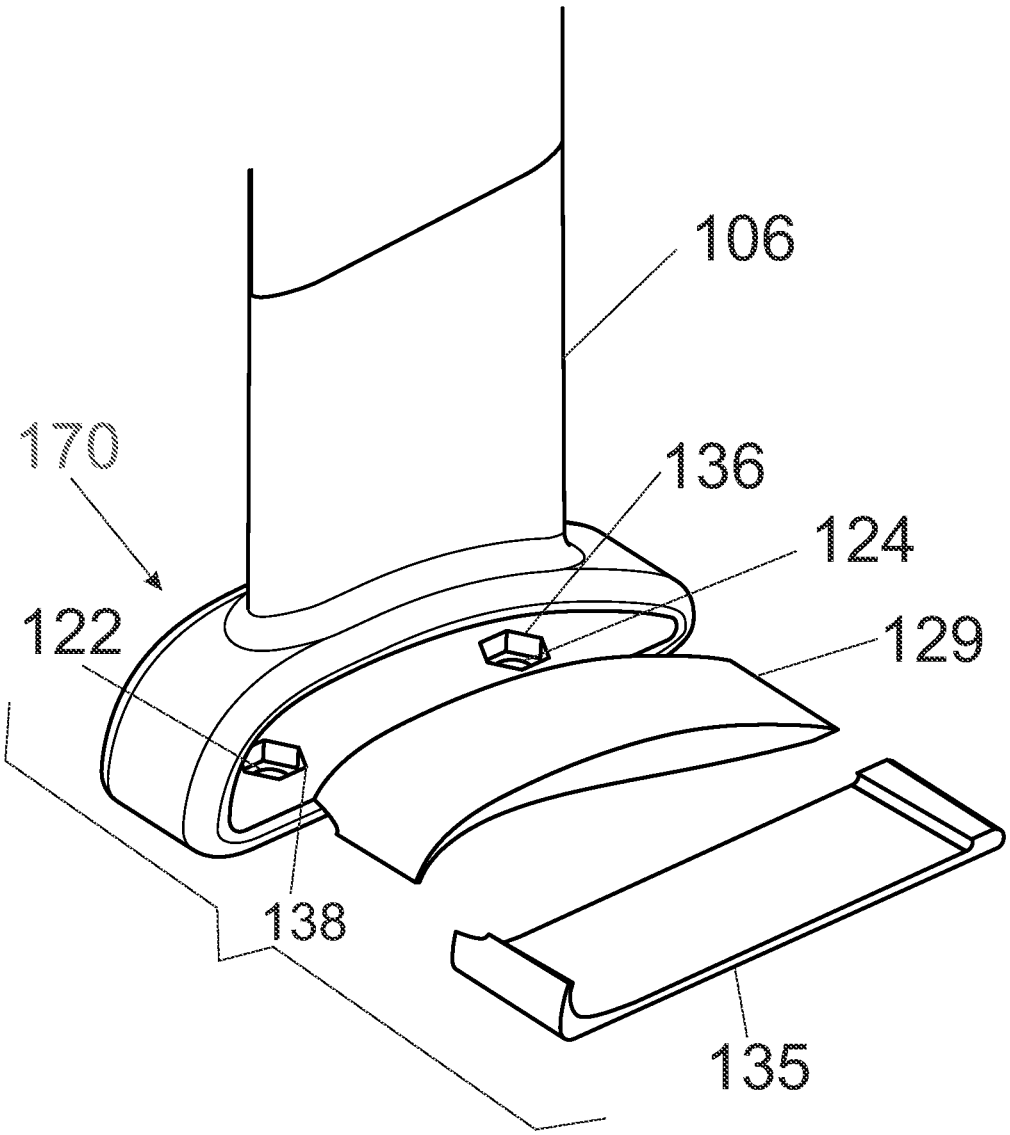
FIG. 2E shows a front-facing isometric view of the hydrofoil wing attachment system as a one piece structure.

In the case where the strut and clamp head are are of a singular construction as shown in FIG. 2E operation of assembly is altered. Assembly of this embodiment entails sliding a wing in through the side of the clamp head or wing clamping apparatus(170), then sliding the top spacer(129) and bottom spacer(135) between the wing and the surrounding clamp head and then clamping via the securing mechanism at the anterior nut well(138) and the posterior nut well(136).

Operation of the Double-Strut Wing Assembly

In the case of the Double-strut Wing Assembly the operator would do the same operations as the Single-strut Assembly except the wing shall be centered between two struts and the assembly process would be duplicated/synchronized between the two struts.

Figure 12:
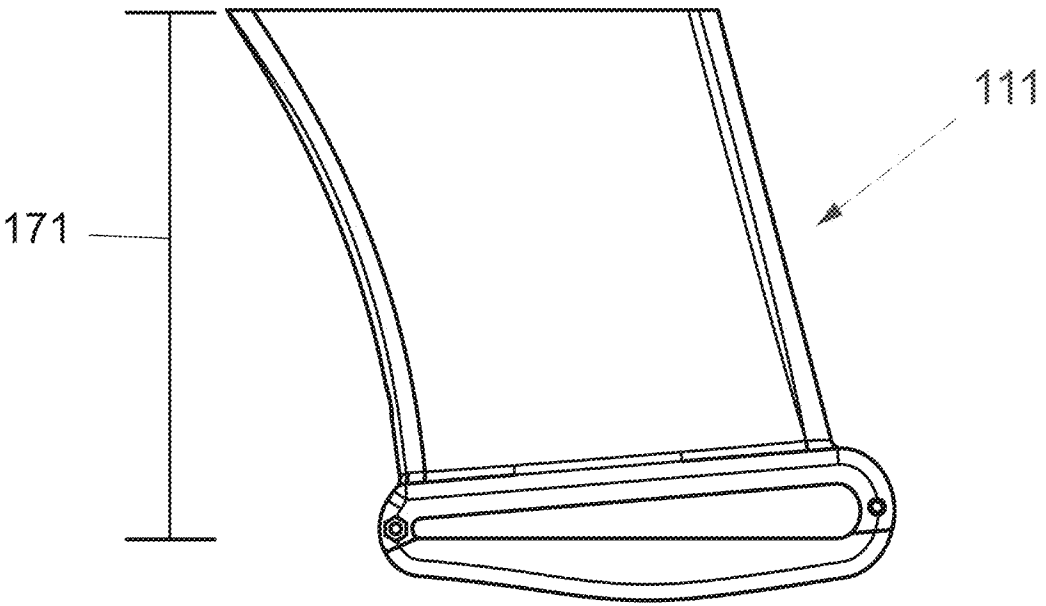
FIG. 12 shows the method of draft measurement of a strut.

Most consistent performance with the hydrofoil wing attachment system shall be achieved with a hydrofoil draft height of between 0.5-10 times the wing chord. With the hydrofoil draft height defined as the distance from the junction of the strut at the watercraft(172) to the midpoint of the bottom of the wing. And with a strut draft height(171) shown in FIG. 12 of between 50 mm and 20 m.

Additional Embodiments

Figure 1B:
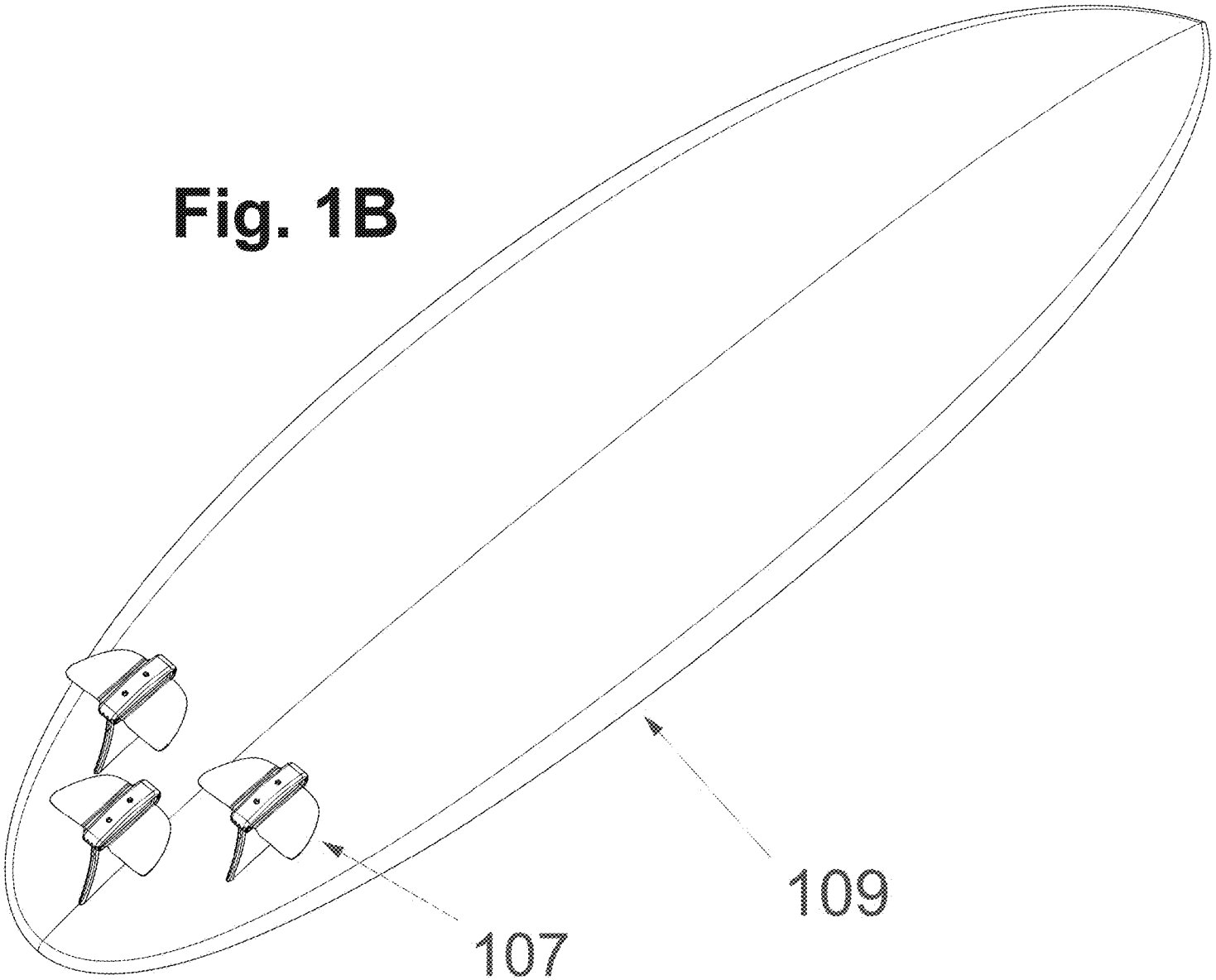
FIG. 1B shows a three fin surfboard assembly view comprising three single-strut wing assemblies.

While the above descriptions contains many specifics, these should not be construed as limitations on the scope, but rather as an exemplification of several embodiments thereof. For example, utilizing the same surfboard with a thruster design or three fin-box a user could configure it as three embodiments: one double-strut wing assembly and one single-strut wing assembly illustrated in FIG. 1A, or one double strut assembly and a standard surfboard fin in the single rear slot or three single-strut wing assemblies as illustrated in FIG. 1B.

With a quad setup or four fin-box surfboard the user could implement various embodiments: two double-strut wing assemblies, or one double-strut wing assembly and two single-strut wing assemblies, or four single-strut wing assemblies or one double-strut wing assembly and two standard surfboard fins.

With the surfboard having a five fin-box setup or bonzer configuration the user could implement the various embodiments: two double-strut wing assemblies and one single-strut wing assembly, or one double-strut wing assembly and three single-strut assemblies, or five single-strut wing assemblies.

With the surfboard having a twin fin setup or with two fin-boxes the user could implement the two embodiments: one double-strut wing assembly, or two single-strut wing assemblies. Other fin configurations that currently are not popular with current surfboard designs, but may with the introduction of the hydrofoil wing attachment system.

Description and Operation of Alternative Embodiments

Figure 13B:
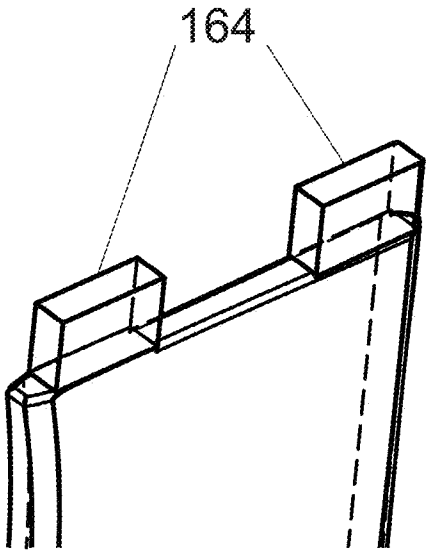
FIGS. 13A-B show representations of a strut body integrated with a legacy fin connection system insert, prior art U.S. Pat. No. 5,464,359 to Whitty (1995) and prior art U.S. Pat. No. 5,830,025 to Fleming (1998).

Alternative methods of attachment to the base connection interface include, but is not limited to: legacy fin box system connector insert U.S. Pat. No. 5,464,359 to Whitty (1995) 164 exhibited in FIG. 13B and U.S. Pat. No. 5,830,025 to Fleming (1998) 110 exhibited in FIG. 13A, direct glass-on models, mechanical attachment models and methods, and other methods and systems of attachment and connection.

The hydrofoil wing attachment system could be implemented upon watercraft other than the surfboard including: kayaks, windsurfers, paddle-boards, kiteboards, boogie-boards, canoes, foam boards, and other related watercraft.

Alternative Strut Embodiments

Figure 11:
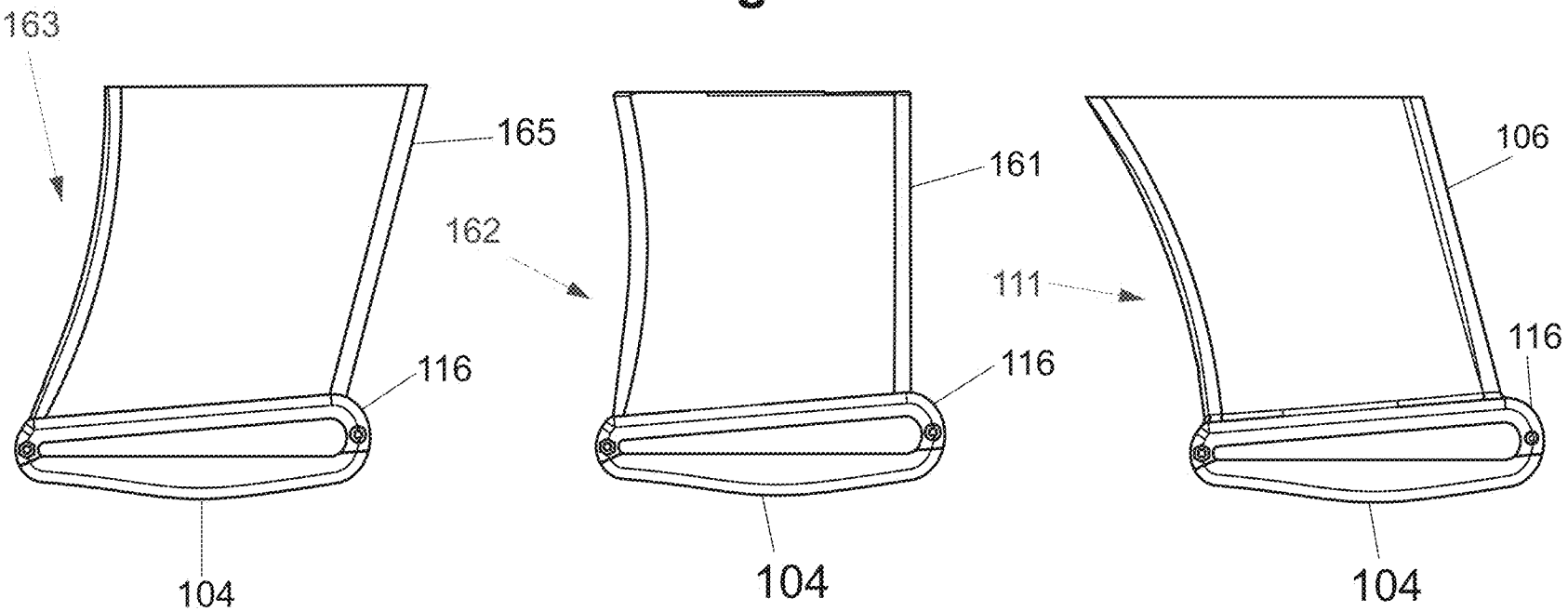
FIG. 11 shows various rake embodiment's of a strut assembly.

The hydrofoil wing attachment system encompasses struts with various rake or tilt configurations. This is documented in FIG. 11 with the various styles of rake being: forward rake (106), neutral or straight rake (161), aft tilt (163).

Alternative Draft Heights of Struts

Figure 13A:
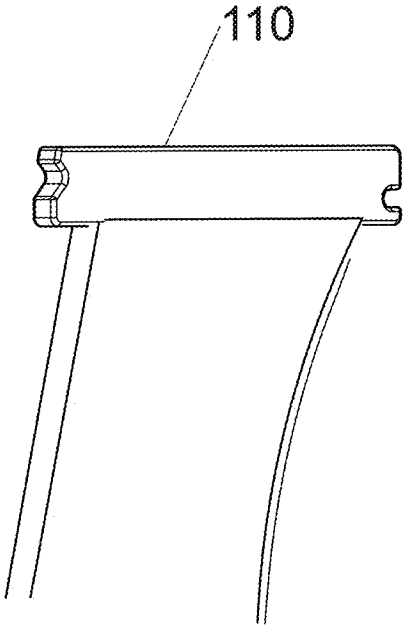

Alternative embodiments of the strut height as a component of the hydrofoil wing attachment system (FIG. 13A —171). Various draft heights would allow for different applications and in situations with varying performance requirements. Ranging in draft height from 50 mm draft to 35 meters.

Alternative Sizes of Clamp-Head Profile

Various embodiments of the wing clamping apparatus 170 including: various scale and ratios of the clamp head, clamp head designs with varying sizes and anatomical designs to accommodate a variety of wing aspect ratios and sizes.

Alternative Strut Horizontal Cross Section Profiles

Figure 14:
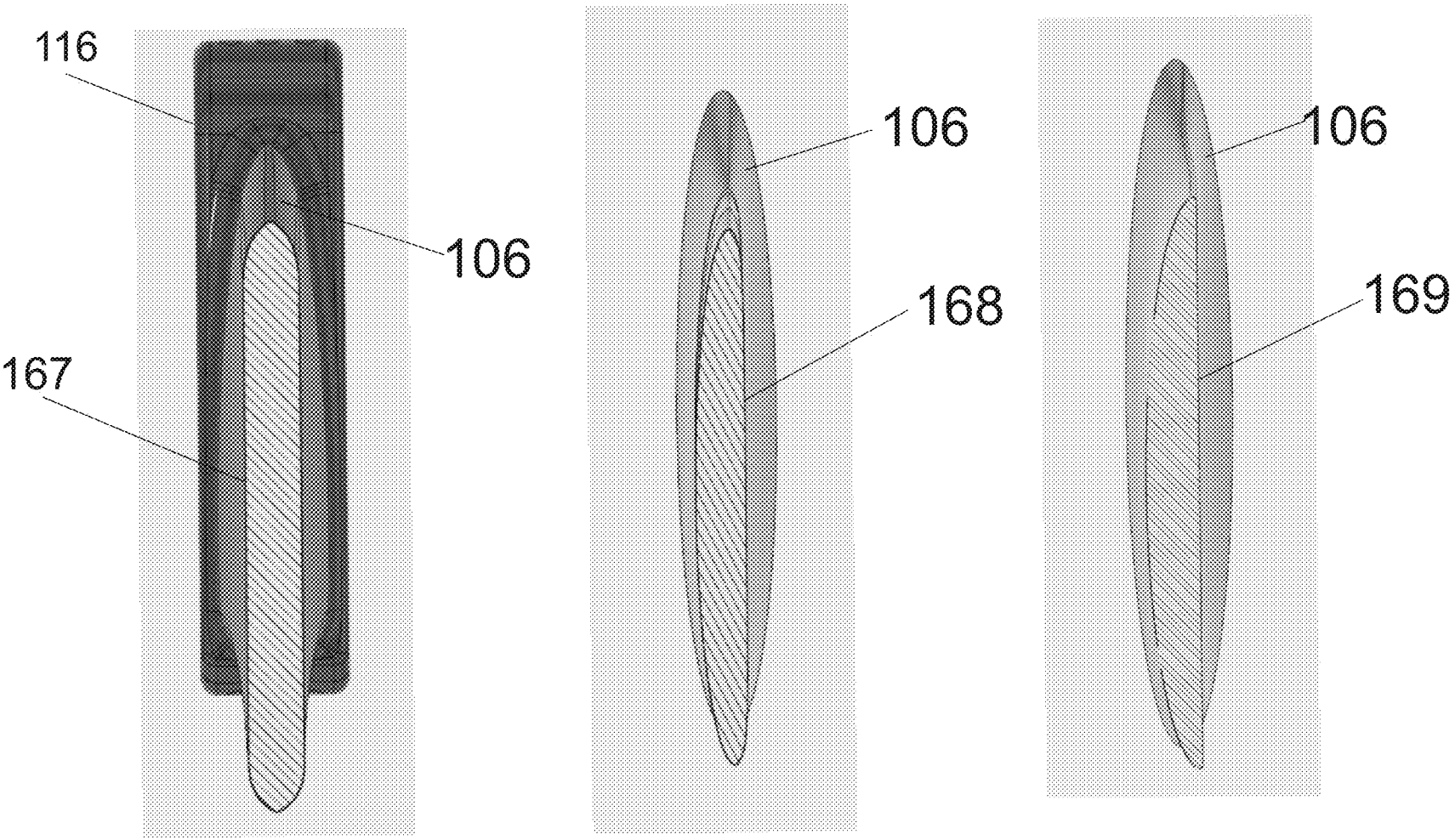
FIG. 14 shows various strut body profiles.

Hydrofoil wing attachment system struts having various horizontal cross section profiles embodying various performance characteristics and use case necessities. These cross section profiles are:

50/50 exemplified by 167 illustrated in FIG. 14.
60/40
70/30
80/20 exemplified by 168 illustrated in FIG. 14.
90/10
100/0 or flat exemplified by 169 illustrated in FIG. 14.
Other potential profile balances reside between 50/50 and flat that are not listed.

Alternative Embodiments of Hydrofoil Wings Designed for Integration with the Hydrofoil Wing Attachment System These alternative embodiments include but are not limited to hydrofoil wings with various aspect ratios/designs with these designs targeting a double-strut wing assembly.

Figure 6A:
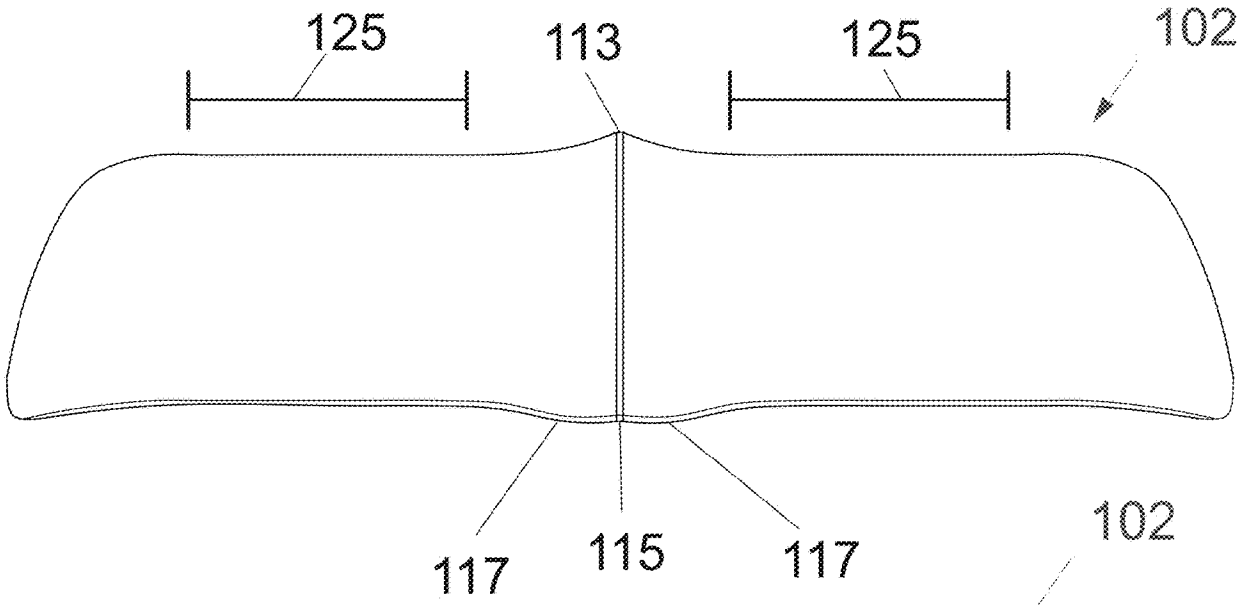
FIGS. 6A-C show various views of a dragonwing style wing to be utilized with a double-strut wing assembly.
Figure 6B:
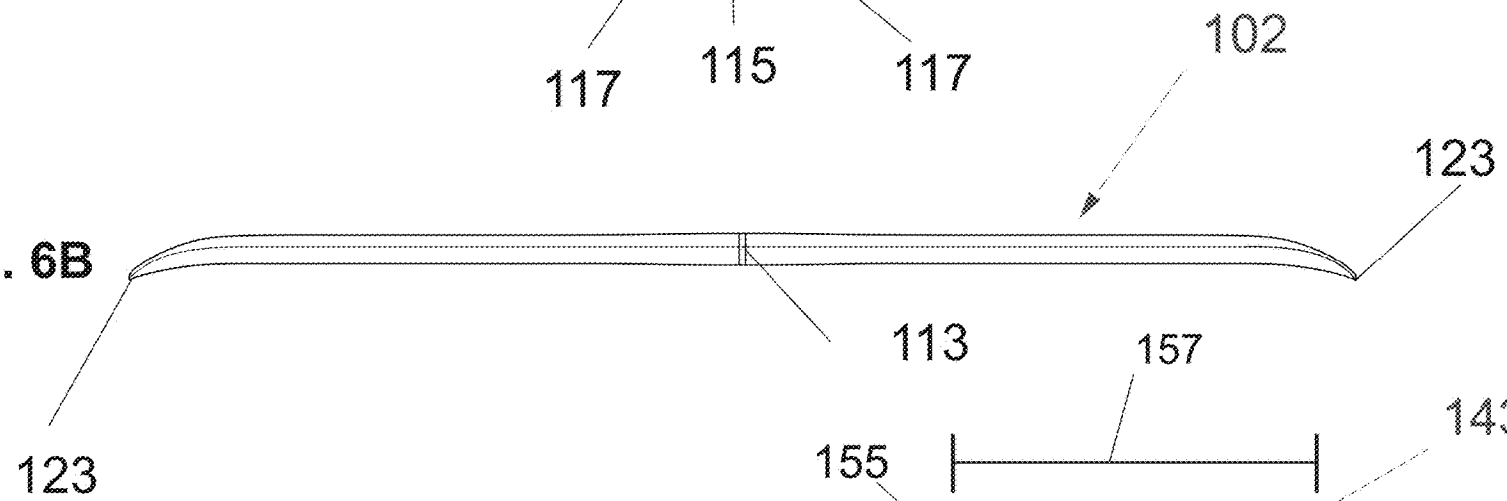

Dragonwing style hydrofoil wing design illustrated in FIG. 6A, consisting of potential alternative embodiments with both wing tips curved down, both wing tips curved up, or straight wing tips.

Figure 7A:
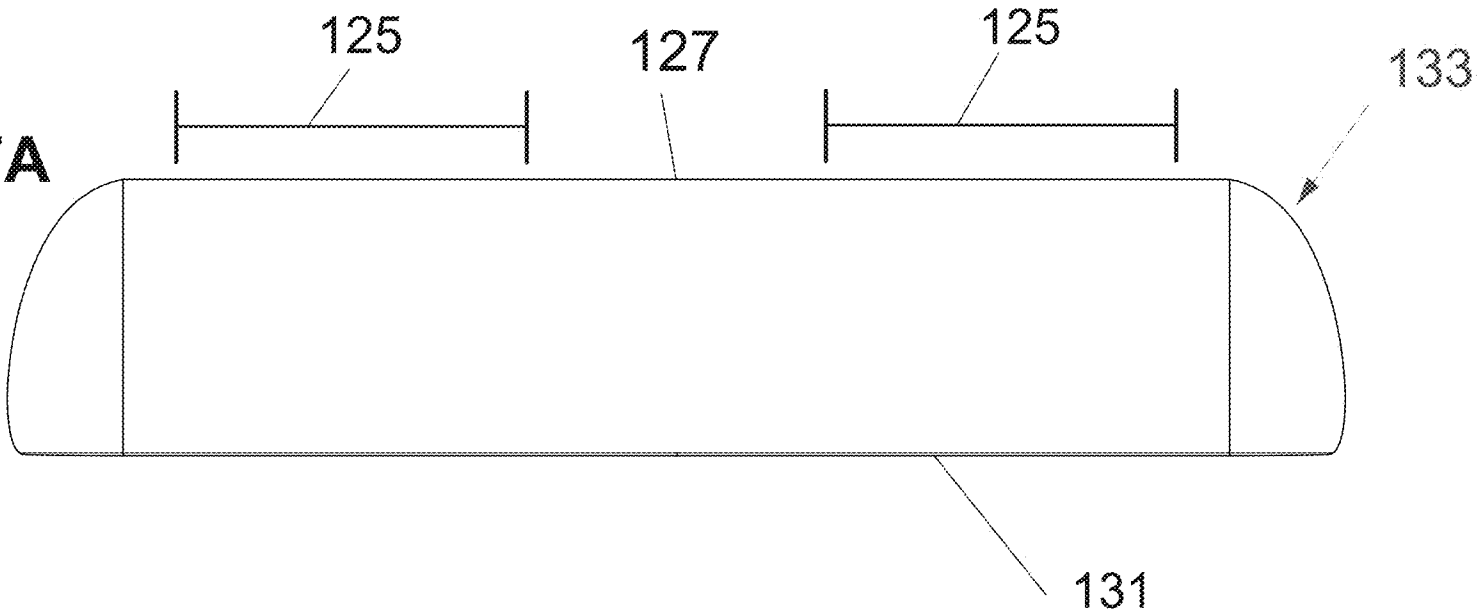
FIGS. 7A-C show various views of a straight-edge style wing to be utilized with a double-strut wing assembly.
Figure 7B:
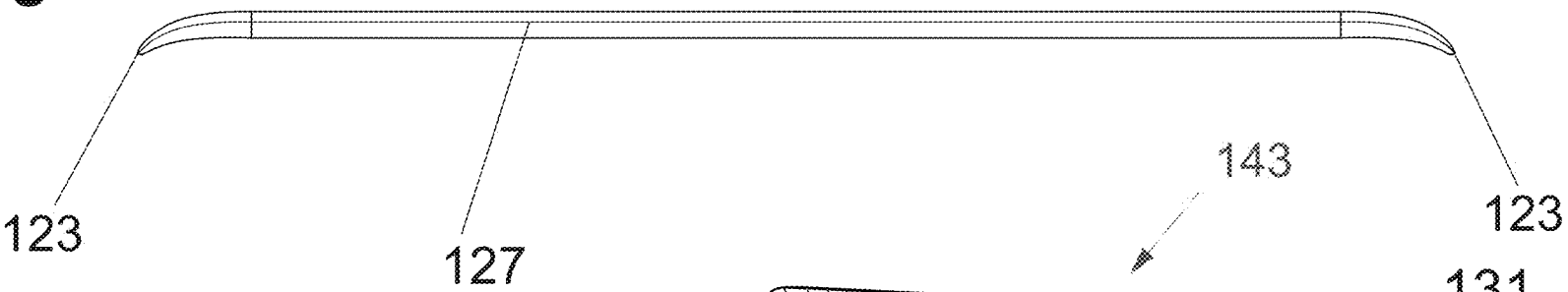
Figure 7C:
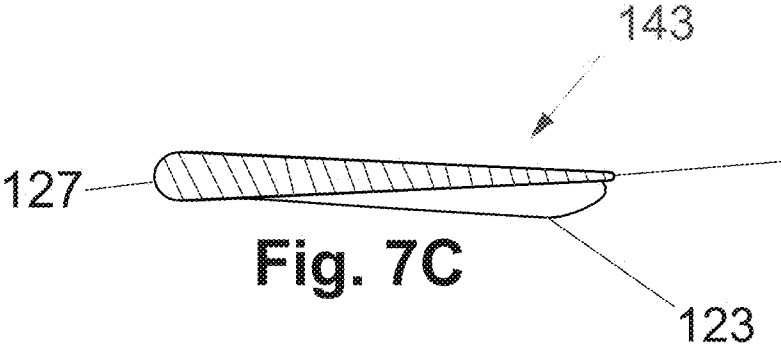

Straight-edge style hydrofoil wing design illustrated in FIG. 7A, consisting of alternative embodiments with the both wing tips curved down, both wing tips curved up, or straight wing tips.

Figure 8A:
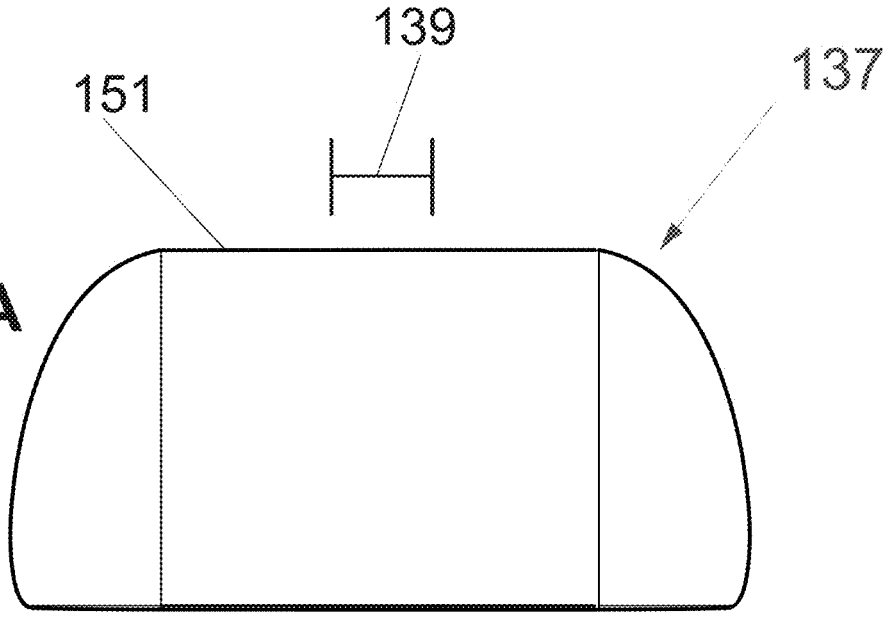
FIGS. 8A-C show various views of a straight-edge style wing to be utilized with a single-strut wing assembly.
Figure 8B:
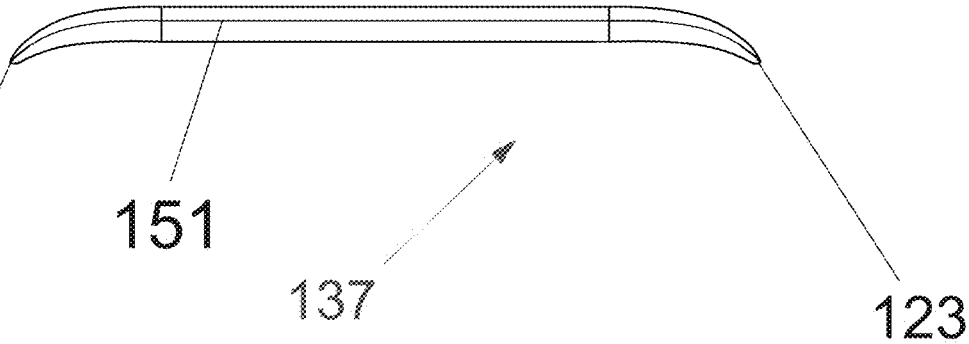
Figure 8C:
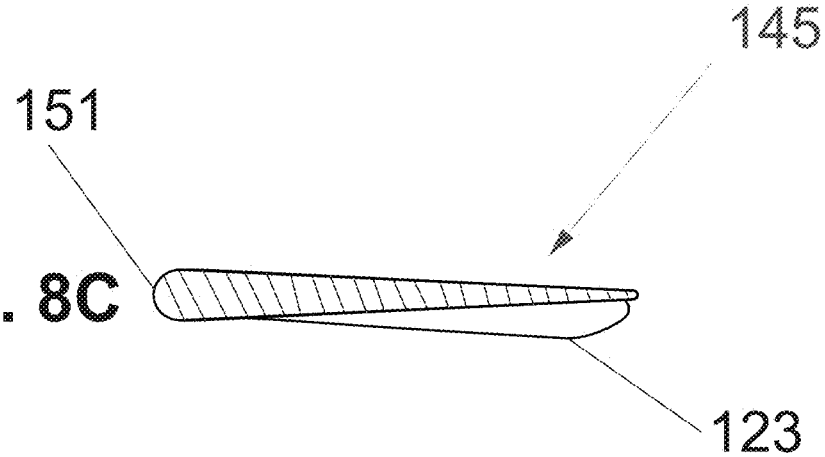

Alternative embodiments of hydrofoil wings targeting a single-strut wing assembly include but is not limited to:

Straight edge hydrofoil wing illustrated in FIG. 8A, consisting of alternative embodiments with the wing tips curved down, wing tips curved up, or with straight wing tips.

Figure 9A:
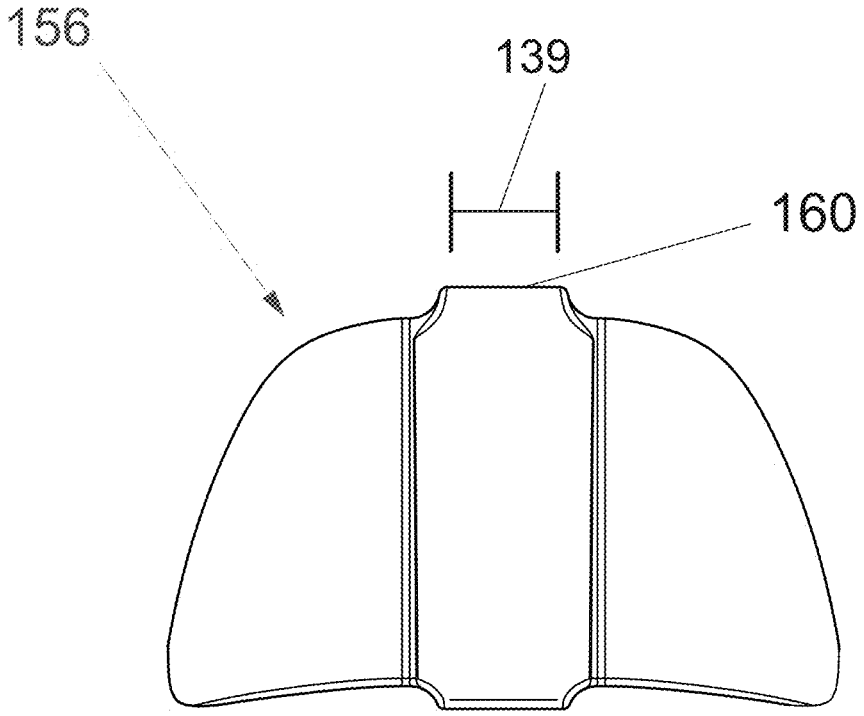
FIGS. 9A-B show various views of an out-dented style wing to be utilized with a single-strut wing assembly.
Figure 9B:
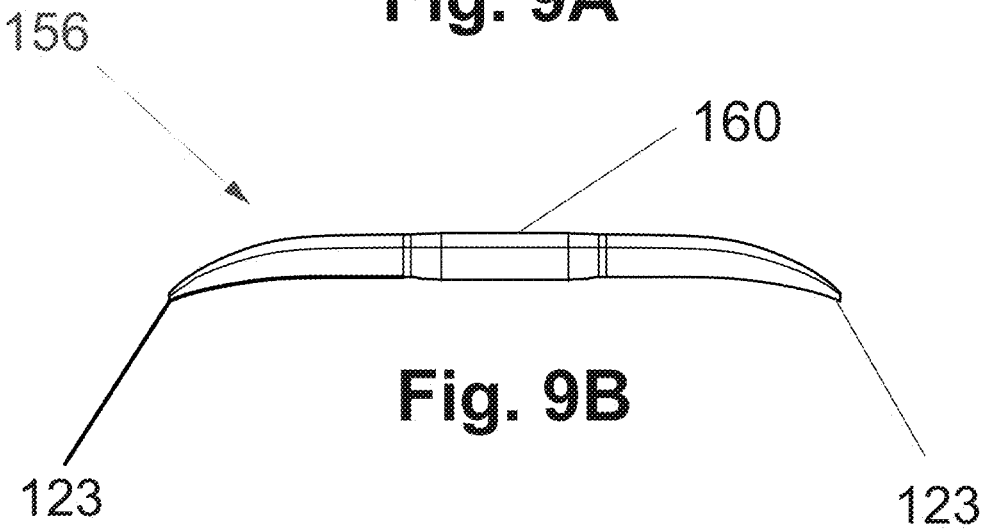

Out-dent style hydrofoil wing design illustrated in FIG. 9A, consisting of alternative designs: with the wing tips curved down, wing tips curved up, straight wing tips.

Figure 10A:
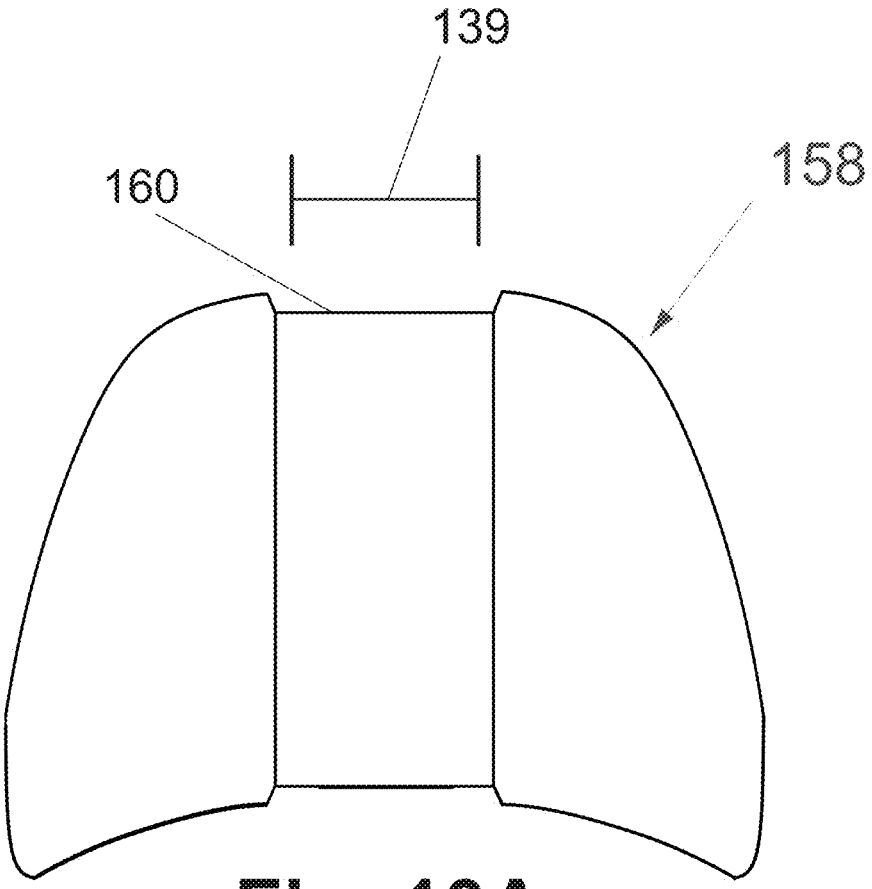
FIGS. 10A-B show various views of an indented style wing to be utilized with a single-strut wing assembly.
Figure 10B:
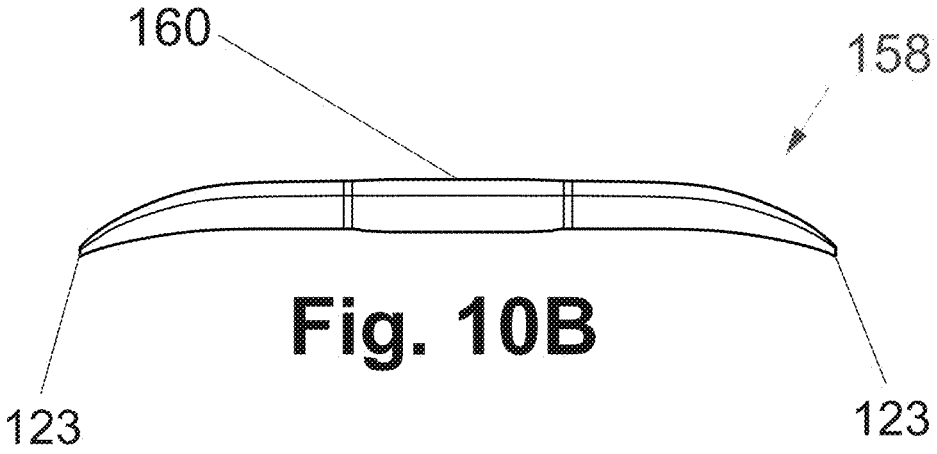

Indent Style hydrofoil wing design illustrated in FIG. 10A, consisting of alternative designs: with the wing tips curved down, wing tips curved up, straight wing tips.

Alternative Wing Chord Sizes

Figure 6C:
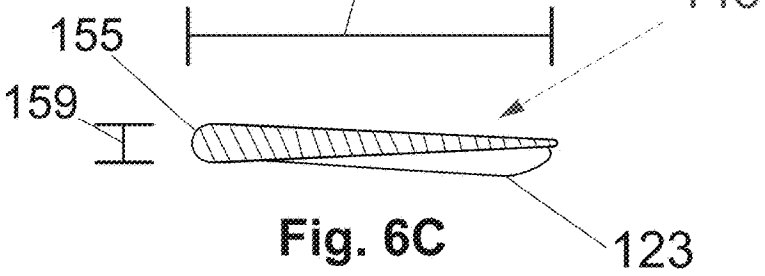

The chord measurement of a wing is demonstrated in FIG. 6C, 157. Alternative hydrofoil wing chord sizes would be utilized for various performance requirements and different use case scenarios.

Alternative Wing Thicknesses

The height of a wing is demonstrated in FIG. 6C, 159. Alternative wing height sizes would be utilized for various performance requirements and different use case scenarios.

Alternative Wing Cross Section Designs

The cross section of a wing is demonstrated in FIG. 6C, 155. Alternative wing cross section designs would be utilized for various performance requirements and different use case scenarios.

Alternative Construction Embodiments, Configurations, and Methods

Alternative embodiments of hydrofoil wing attachment system as singularly molded components would include:

Utilizing any of the modular configurations detailed throughout the hydrofoil wing attachment system description and the alternative embodiments section as a singular molded piece.

Utilizing the various multiple piece components of the hydrofoil wing attachment system as singularly molded pieces.

Construction materials used to produce the hydrofoil wing attachment system could include, but is not limited to: plastics, metals, composites, wood, laminates, ceramics, polymers, rubbers, carbon fiber, carbon based materials, and fiber reinforced substrates.

Methods of construction for producing the hydrofoil wing attachment system could include but is not limited to: hand construction, multi-part mold fabrication and production, injection molding, additive manufacturing, FDM 3d Printing, SLA/DLP 3d printing, sintering, reductive manufacturing, CNC machine.

Advantages of Invention

An advantage of one embodiment of the hydrofoil wing attachment system is the ability to attach a hydrofoil wing around a longitudinal section of the hydrofoil wing. Then once attached the hydrofoil wing can be further secured mechanically from both the top and bottom of the wing clamping apparatus. This method of attachment and securement of the hydrofoil wing reduces friction and vibration, increases stability, and allows for quick adjustments to the hydrofoil wing.

Another advantage of the wing clamping apparatus as previously described enables a user to adjust the angle-of-attack of a hydrofoil wing via the interplay of the securing mechanisms within the wing clamping apparatus. Changes made to the angle of attack can alter the speed and performance characteristics of the hydrofoil wing.

Another advantage of one embodiment of the hydrofoil wing attachment system is the ability to attach a hydrofoil wing to a watercraft via commercially standard surfboard fin box systems. Allowing the user to change between standard surfboard fins and hydrofoil wings and transform their surf-craft into a hydrofoil craft and back again in a few simple steps. With a mounted hydrofoil wing the user can then attain higher speeds with less drag/friction/turbulence than current fin systems due to the planar/hydrodynamic benefits of the hydrofoil wing.

The component based design greatly increases the level of modularity and also the interchangeability of the system in comparison to prior art. These characteristics allow quick implementation of different wing/strut configurations illustrated by a single-strut wing assembly embodiment and a double-strut wing assembly embodiment. The modular and interchangeable nature also allows for the utilization of varying size wings along parameters of length, chord, and thickness to be fastened using standard commonly used tools.

CONCLUSION

Accordingly the reader will see that the previously described advantages showcase some of the performance, implementation, and operational advantages inherent in the hydrofoil wing attachment system as described. In showcasing the advantages of the hydrofoil wing attachment system the limitations inherent in the current prior art are highlighted. Furthermore these advantages coalesce to form a distinct departure from the current prior art and open up a vast frontier of performance, implementation, and operational possibilities. Possibilities that can now be realized by the user due to the modular, interchangeable, extensible, and configurable nature of the hydrofoil wing attachment system. These qualities empower the user to experiment with multiple wing configurations, strut configurations, assembly configurations, and angle of attack settings. In essence the hydrofoil wing attachment system is a set of components that allow for the exploration of a much larger geography of hydrofoil performance than the prior art. Thus allowing for the greater likelihood and potential attainment of maximal or peak performance.

I claim:

1. A hydrofoil wing attachment system comprising:

at least one strut attached to a watercraft;

at least one clamp head that connects to the strut, wherein the clamp head comprises an upper clamping portion and a lower clamping portion each having a plurality of projections at the front and rear end, wherein the plurality of projections of the upper clamping portion interlock with the plurality of projections of the lower clamping portion and surround a hydrofoil wing along a longitudinal section of the hydrofoil wing; and a fastening mechanism that secures the hydrofoil wing with said at least one strut.

2. The hydrofoil wing attachment system of claim 1 wherein the strut and the upper clamping portion are constructed as a one piece structure.

3. The hydrofoil wing attachment system of claim 1 is implemented as a single-strut hydrofoil wing assembly.

4. The hydrofoil wing attachment system of claim 1 is implemented as a double-strut hydrofoil wing assembly, wherein said at least one strut comprises two struts, and wherein said at least one clamp head comprises two clamp heads each connected to a respective one of the struts.

5. The hydrofoil wing attachment system of claim 1 wherein said fastening mechanism allows a user to configure the angle of attack of the hydrofoil wing.

6. The hydrofoil wing attachment system of claim 1 having a hydrofoil draft height of 0.5 to 10 times the length of the wing chord.

7. The hydrofoil wing attachment system of claim 1 having a strut draft height of between 50 millimeters and 20 meters.

8. The hydrofoil wing attachment system of claim 1 wherein at least one clamp head comprises a spacer system.

9. The hydrofoil wing attachment system of claim 8 wherein the spacer system is configured to modify the angle of attack of the hydrofoil wing.

* * * * *